United States Patent [19]

Martell et al.

[11] 4,403,558

[45] Sep. 13, 1983

[54] CONTROL SYSTEM FOR SEWING MACHINE

[75] Inventors: Charles R. Martell; Elmer N. Leslie; Don D. Isett, all of Dallas; Stephen S. Treadwell, Richardson, all of Tex.

[73] Assignee: Microdynamics, Inc., Dallas, Tex.

[21] Appl. No.: 210,197

[22] Filed: Nov. 26, 1980

Related U.S. Application Data

[63] Continuation-in-part of Ser. No. 168,525, Jul. 14, 1980, Pat. No. 4,359,953.

[51] Int. Cl.[3] ..... D05B 19/00

[52] U.S. Cl. ..... 112/121.11; 112/272; 112/275

[58] Field of Search ..... 112/121.11, 121.12, 112/272, 273, 275, 278, 2, 158 E

[56] References Cited

U.S. PATENT DOCUMENTS

| | | | |
|---|---|---|---|
| 3,750,603 | 8/1973 | Martin | 112/121.11 X |
| 3,799,084 | 3/1974 | Furnari | 112/121.11 |
| 3,827,381 | 8/1974 | Baanstra et al. | 112/121.11 |
| 4,195,582 | 4/1980 | Novick et al. | 112/121.11 |
| 4,226,197 | 10/1980 | Pollmeier et al. | 112/121.11 |

*Primary Examiner*—Peter P. Nerbun

*Attorney, Agent, or Firm*—Jerry W. Mills

[57] ABSTRACT

An adaptive semiautomatic sewing system (10) comprises a sewing machine (12), a drive unit (42) including a variable speed motor and encoder for counting stitches sewn, at least one material edge sensor (40) mounted ahead of the needle (22) of the sewing machine, and a microprocessor controller (51) coupled to the sewing machine controls. The system (10) has manual, teach and auto modes of operation. In the teach mode, control parameters for each seam are stored as the operator sews the initial piece. Accurate control of seam lengths and end points is achieved by initiating countdown of a variable number of final stitches responsive to detection of the material edges by the sensors (40). In one embodiment, a window is set up around the stitch count at which terminal countdown initiates to avoid spurious signals. In another embodiment, momentary toggles of the sensors (40) are ignored so that an even wider range of sizes can be sewn with the same taught program.

15 Claims, 21 Drawing Figures

TEACH MODE

AUTO MODE
230
CLEAR SEAM STITCH COUNT
232
SENSOR COUNT < 5 ?
YES
NO
SET WINDOW FLAG = 0
234
SET WINDOW FLAG = 1 SET WINDOW COUNT = .75 SENS. COUNT
236
238
STITCH TAKEN ?
NO
YES
240
INCREMENT STITCH COUNT
242
WINDOW FLAG = 1 ?
NO
YES
244
STITCH CNT. = STORED STITCH COUNT ?
NO
YES
246
STITCH COUNT ≥ WINDOW CNT. ?
NO
YES
248
READ SENSORS
250
SENS. CODE = STORED SENS. CODE ?
NO
YES
252
SET WINDOW FLAG = 0 AND STITCH COUNT = STORED SENSOR COUNT

TEACH MODE

AUTO MODE

AUTO MODE

CONTROL SYSTEM FOR SEWING MACHINE

CROSS-REFERENCE TO RELATED APPLICATION

This application is a continuation-in-part of copending application Ser. No. 168,525, filed July 14, 1980, now U.S. Pat. No. 4,359,953.

TECHNICAL FIELD

The present invention relates generally to a control system to adapt a sewing machine for semi-automatic operation. More particularly, this invention is directed to an adaptive sewing machine control system incorporating a microprocessor controller in combination with stitch counters and edge sensors to achieve more precise seam lengths and end points.

BACKGROUND ART

In the sewn goods industry, where various sections of material are sewn together to fabricate products, reasonably precise seam lengths and/or end points are often necessary for proper appearance and function of the finished products. Consider, for example, the collar of a shirt or other garment. The top stitch seam must closely follow the contour of the collar and terminate at a precise point. In the construction of shoes, accurate seam lengths must be maintained when sewing together the vamps and quarter pieces to achieve strength as well as pleasing appearance. Seams with imprecise lengths and/or end points can result in unacceptable products or rejects, thus causing waste and further expense.

Achieving consistently accurate seam lengths and/or end points at high rates of production, however, has been a long standing problem in the industry. Sewing machines traditionally have been controlled by human operators. Rapid coordination of the operator's eyes, hands and feet is necessary to control a high speed industrial sewing machine. Considerable practice, skill and concentration are required to sew the same type of seam with consistent accuracy time and time again.

Since such sewing operations tend to be repetitive and therefore lend themselves to automation, systems have been developed heretofore for automatically controlling sewing machines. U.S. Pat. Nos. 4,108,090, 4,104,976, 4,100,865 and 4,092,937 assigned to the Singer Company are representative of such devices. Each of these patents discloses a programmable sewing machine with three operational modes: manual, auto and learning. Control parameters are programmed into the system as the operator manually performs the initial sewing procedures for subsequent control of the sewing machine in the auto mode.

While these programmable sewing machines have several advantages over manually controlled machines, they are not without their disadvantages. The prior sytems rely upon overall stitch counting to determine seam lengths and/or end points, variations in which can be caused by several factors. First, cloth or fabric is a relatively elastic material which can be stretched or contracted by the operator during the sewing procedure, thereby causing changes in average stitch lengths which can accumulate into a significant deviation over the length of a seam. Second, slippage can occur as the material is advanced between the presser foot and feed dog of the sewing machine, thereby causing further deviations in the length of the seam. Also, such slippage can vary in accordance with the speed of the sewing machine. Third, any deviations between the paths of the desired seams versus the paths of the seams as programmed can also contribute to inaccurate seam lengths. Variations in seam lengths become greatest with long seams and elastic material.

Thus, although the programmable sewing machines of the prior art offer higher speeds of operation, they have not been satisfactory in those applications where precise seam lengths and end points are required.

Another approach to the problem of stopping a sewing machine precisely and consistently at a given point was proposed in an article entitled "Fluidics for the Apparel Industry", Journal of the Apparel Research Foundation, Vol. 3, 1969. It was proposed to mount a sensor in the presser foot of the sewing machine for sensing the edge of the material by which to initiate countdown of a preset number of stitches for stopping the machine at the desired point. This proposal, however, does not take into account the fact that edge conditions are dependent upon the seam and type of workpiece. No single preset number of stitches works well with pieces of different shapes or similar pieces of different sizes. As far as Applicants are aware, however, this proposal never has been embodied in a programmable sewing system.

A need therefore has arisen for an adaptive sewing machine control system utilizing a combination of stitch counting and edge detection techniques to obtain more accurate seam lengths and/or end points.

SUMMARY OF THE INVENTION

The present invention comprises a sewing machine control system which overcomes the foregoing and other difficulties associated with the prior art. In accordance with the invention, there is provided a system including a microprocessor controller which can be programmed with or taught a sequence of sewing operations by the operator in one mode, while sewing the initial piece, for automatically controlling the machine during subsequent sewing of similar pieces of the same or different sizes in another mode. The semi-automatic system herein does not rely upon either pure stitch counting or material edge detection alone, but rather utilizes a combination of these techniques together with other features to achieve more accurate seam length and end point control.

More specifically, this invention comprises a microprocessor-based control system for an industrial sewing machine. The system has manual, teach and auto modes of operation. In a first embodiment, one or more sensors are mounted in front of the presser foot for monitoring edge conditions of the material at the end of each seam. In the teach mode, operating parameters for each seam segment are programmed into the controller by the operator while manually sewing the first piece. For each seam, the number of stitches X sewn at the time of the last status change in the sensors, the sensor pattern or state after X stitches had been sewn, and the total number of stitches Y sewn in the seam are recorded along with sewing machine and auxiliary control inputs. In the auto mode, the number of stitches sewn in each seam is monitored as the count passes a window set up around X until the characteristic sensor pattern is seen, at which time Y-X terminal stitches are sewn to complete the seam.

The number of terminal stitches, as well as the point at which stitch countdown is initiated, can vary from seam to seam such that the present control system is adaptive. Thus, more accurate seam lengths and/or end points are achieved by applying stitch counting to only a very small portion of the terminal end of each seam.

Several modifications for enhancing performance of the microprocessor-based control system herein are also disclosed. One modification relates to minimizing the number of slow stitches and achieving accurate needle positioning at the endpoint of each seam wherein the sewing speed profile, the total number of stitches Y, and the number of stitches Y-X sewn since the last status change in the sensors are recorded in the teach mode and utilized to compute the number of stitches M at which deceleration will be initiated for each seam. During playback in the auto mode, the microprocessor controller monitors the number of stitches sewn at a predetermined stopping speed of the sewing machine, i.e., the speed at which the machine can be stopped substantially instantaneously, and increments or decrements the value M according to whether the seam endpoint was overrun or underrun, respectively, such that the value of M is adaptively adjusted to minimize the number of stitches sewn at slow speed and thereby maximize the number sewn at high speed.

A second modification involves revision of the sensor logic to eliminate the window and thereby accommodate a wider variety of potential sewing conditions such that the endpoint of each seam is adaptively determined regardless of the size or accuracy of the piece.

Revision of the sensor logic to ignore status changes in the sensors which do not endure for more than a predetermined time interval, such as one stitch, comprises the third modification which functions as a filter against spurious signals.

Finally, yet another modification comprises one which allows the system to automatically compensate for the type of machine feed and to achieve, by means of an adaptive algorithm, improved seam length accuracy to plus or minus one-half stitch.

BRIEF DESCRIPTION OF DRAWINGS

A more complete understanding of the invention can be had by reference to the following Detailed Description in conjunction with the accompanying Drawing, wherein.

DETAILED DESCRIPTION

Figure 1:
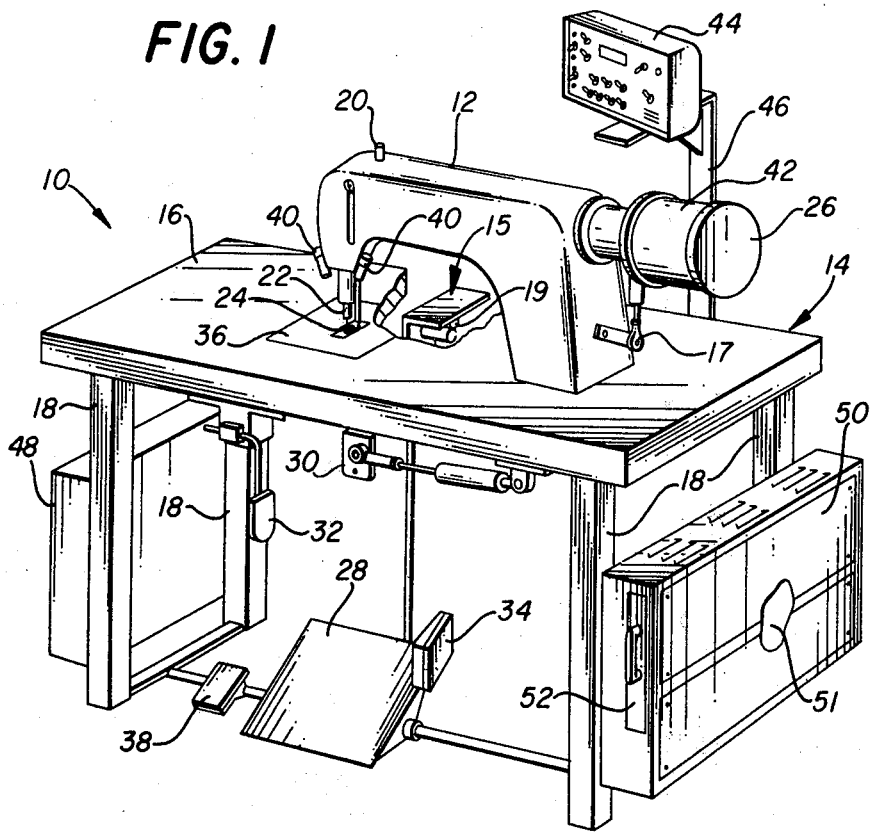
FIG. 1 is a perspective view of a programmable sewing system incorporating the invention.

Referring now to the Drawings, wherein like reference numerals designate like or corresponding parts throughout the views, FIG. 1 illustrates a semi-automatic sewing system 10 incorporating the invention. System 10 is a microprocessor-based system which extends the capabilities of a sewing machine by enabling the operator to perform sewing procedures on a manual or semi-automatic basis, as will be more fully explained hereinafter.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within tabletop 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions like an accelerator. Vertical positioning of presser foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of reverse sew lever actuator 17. A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for commanding machine 12 to sew a single stitch.

It will thus be understood that sewing machine 12 and its associated manual controls are of substantially conventional construction, and may be obtained from several commercial sources. For example, suitable sewing machines are available from Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. A pair of sensors 40 are mounted in laterally spaced-apart relationship in front of needle 22 and presser foot 24. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14.

On one side of work stand 14 there is a pneumatic control chassis 48 containing an air regulator, filter and lubricator for the sewing machine control sensors, pneumatic actuators and other elements of system 10. All of these components are of known construction and are similar to those shown in U.S. Pat. Nos. 4,108,090, 4,104,976, 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals for sensors and carrying control signals to actuators, and a power module for providing electrical power at the proper voltage levels to the various elements of system 10. The microprocessor controller 51 may comprise a Zilog Model Z-80 microprocessor or any suitable unit having a read only memory (ROM) and random access memory (RAM) of adequate storage capacities. An auxiliary control panel 52 is mounted for sliding movement in one end of chassis 50. Operation and function of the foregoing components will become more clear in the following paragraphs.

Figure 2:
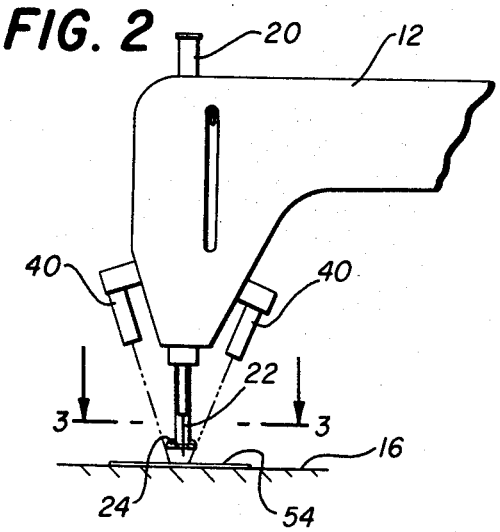
FIG. 2 is a front view illustrating placement of the edge sensors relative to the sewing needle.
Figure 3:
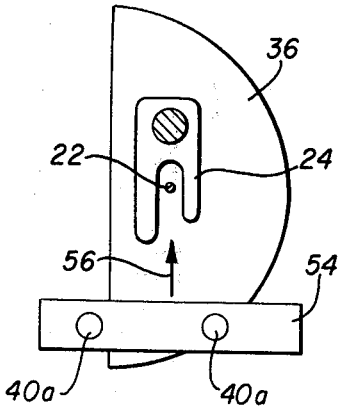
FIG. 3 is a sectional view taken along lines 3—3 of FIG. 2 in the direction of the arrows.

Referring now to FIGS. 2 and 3, further details of edge sensors 40 and their cooperation with needle 22 can be seen. If desired, only one edge sensor 40 can be used with sewing machine 12; however, complex shaped parts may require two or even three edge sensors located in laterally spaced-apart relationship in front of the needle. Sensors 40 can be mounted directly on the housing of sewing machine 12, or supported by other suitable means. As illustrated, each sensor 40 comprises a lamp/photosensor which projects a spot of light 40*a* onto a reflective strip 54 on throat plate 36. The status of each sensor 40 is either on or off depending upon whether the light beam thereof is interrupted, such as by passage of material over reflective strip 54 in the direction of arrow 56 in FIG. 3. Sensors 40 thus function to sense the presence of material being sewn and to signal the approach of the seam end by sensing passage of the trailing edge of the particular piece of material.

It will be appreciated that a significant feature of the present invention comprises usage of at least one and possibly a plurality of sensors 40 positioned in mutually spaced relationship ahead of needle 22 of sewing machine 12. Sensors 40 indicate whether or not the end of a particular seam is being approached. The condition of at least one sensor 40 changes as the trailing material edge passes thereunder to indicate approach of the seam end point. Sensors such as the Model 10-0672-02 available from Clinton Industries of Carlstadt, N.J., have been found satisfactory as sensors 40; however, infrared sensors and emitters, or pneumatic ports in combination with back pressure sensors could also be utilized, if desired. Any type of on/off sensors capable of detecting the presence or absence of material a preset distance in front of needle 22 can be utilized with apparatus 10 since the exact mode of their operation is not critical to practice of the invention.

Figure 4:
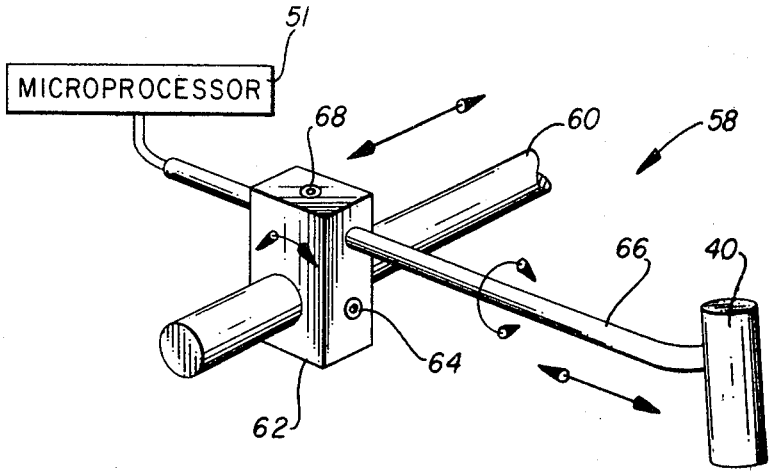
FIG. 4 is an illustration of the sensor mounting.

Sensors 40 can be mounted directly on the housing of sewing machine 12 or on a mounting assembly 58 as shown in FIG. 4. Assembly 58 includes a transverse support bar 60 to which is attached a mounting block 62 for each sensor 40. Mounting blocks 62, only one of which is shown, are slidable and rotatable relative to support bar 60, and can be secured in any desired position thereon by means of set screws 64. Each sensor 40 is attached to the end of a rod 66 slidably extending through its corresponding block 62 and secured in place by set screw 68.

Mounting assembly 58 thus facilitates adjustment of sensors 40 in the desired spaced relationship with respect to each other and with respect to sewing needle 22 in accordance with the shape of the material being sewn and other considerations of the particular sewing operation. Reflective tape 54, of course, could also be repositioned accordingly.

Figure 5:
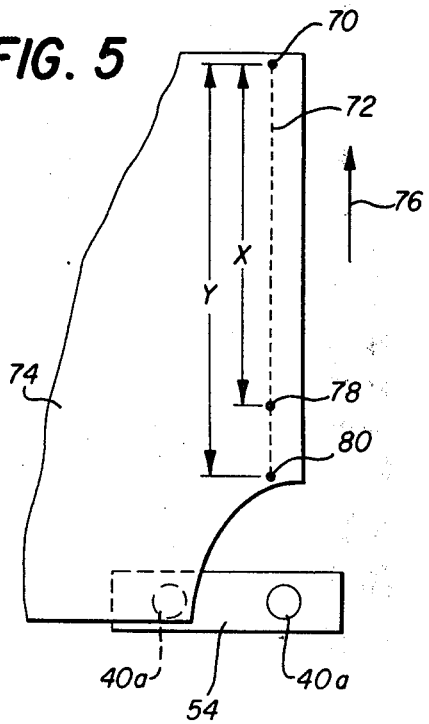
FIG. 5 is an illustration of a piece of material being provided with a seam by means of the invention.

The operation and function of sensors 40 will be better understood upon reference to FIG. 5. Beginning at start point 70, a seam 72 is sewn along a piece of material 74 as the material is fed through sewing machine 12, which is not shown in FIG. 5, in the direction of arrow 76. Simultaneously, the number of stitches from start point 70 is being counted by the encoder within drive unit 42. Since reflective tape 54 is covered for a substantial portion of seam 72, the beams of sensors 40 are blocked and the conditions of both sensors are unchanged. At point 78 in seam 72, after X stitches have been sewn, one of the sensors 40 is cleared to change its condition thereby indicating approach of the end of the seam. Y represents the number of stitches sewn between start point 70 and end point 80 of seam 72. The value Y-X thus represents the number of stitches between points 78 and 80 for each seam.

The values X and Y along with the last change in condition of sensors 40 for each seam are stored and used by microprocessor controller 51 to control sewing machine 12 during operation of system 10 in the AUTO mode. Since the length of each seam and the boundary profile of the material following each seam may vary, it will be appreciated that the values X and Y change with the particular seam and workpiece being sewn such that system 10 is adaptive. In addition to the more common devices found on a sewing machine, such as the presser foot lift actuator, reverse sew actuator and thread trimmer actuator, it will be appreciated that auxiliary devices including stackers, trimmers, guides and zig-zag lever actuators also can be controlled in this fashion as a function of stitch count and material edge detection.

Figure 6:
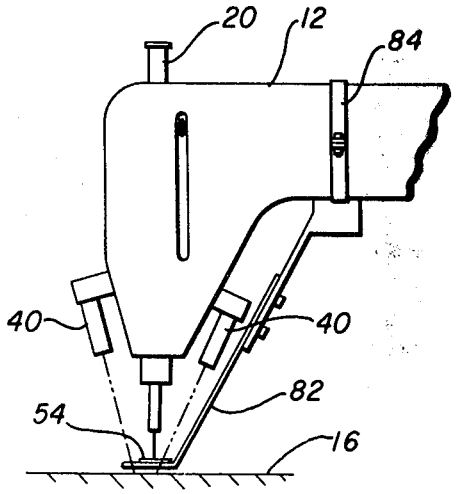
FIG. 6 is a front view of an optional ply splitter.

Referring now to FIG. 6, the seam being sewn may not approach the boundary of the bottom ply of material in some procedures, such as when sewing a patch pocket onto the front panel of a shirt. In such cases tape 54 can be positioned on a ply splitter or separator plate 82 positioned for passage between the upper and lower plies of material. Separator plate 82 can be attached to the housing of sewing machine 12 with a clamp band 84, or supported in any other suitable manner. Use of separator plate 82 thus insures that the boundary of the relevant ply of material being sewn is properly sensed.

Figure 7:
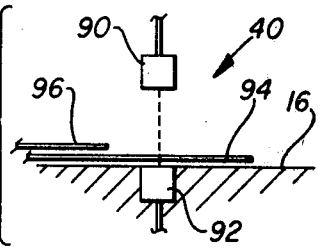
FIG. 7 is an illustration of an alternative sensor.

FIG. 7 illustrates an alternative approach to sensing the boundary of the relevant ply of material being sewn which eliminates the need for a ply splitter or separator plate 82. If desired, each sensor 40 can comprise an infrared emitter 90 of adjustable radiation intensity positioned above an infrared sensor 92 mounted flush in the table top 16. This approach permits adjustment of the output of the infrared emitter 90 in accordance with the number of plies being sewn. For example, when sewing a single ply of material 94, the output of emitter 90 would be set to a relatively low level so that a single layer of material would block sensor 92 and thereby change the condition of sensor 40. On the other hand, if a patch pocket or second ply of material 96 were being sewn onto a first ply of material 94, the energy output level of emitter 90 would be set to a relatively higher level sufficient to penetrate one ply of material but not two plies of material. Suitable infrared emitters and sensors are available from Spectronics, Inc. of Richardson, Tex. Use of such variable sensitivity sensors 40, such as IR emitters and sensors, thus lends additional flexibility to system 10.

Figure 8:
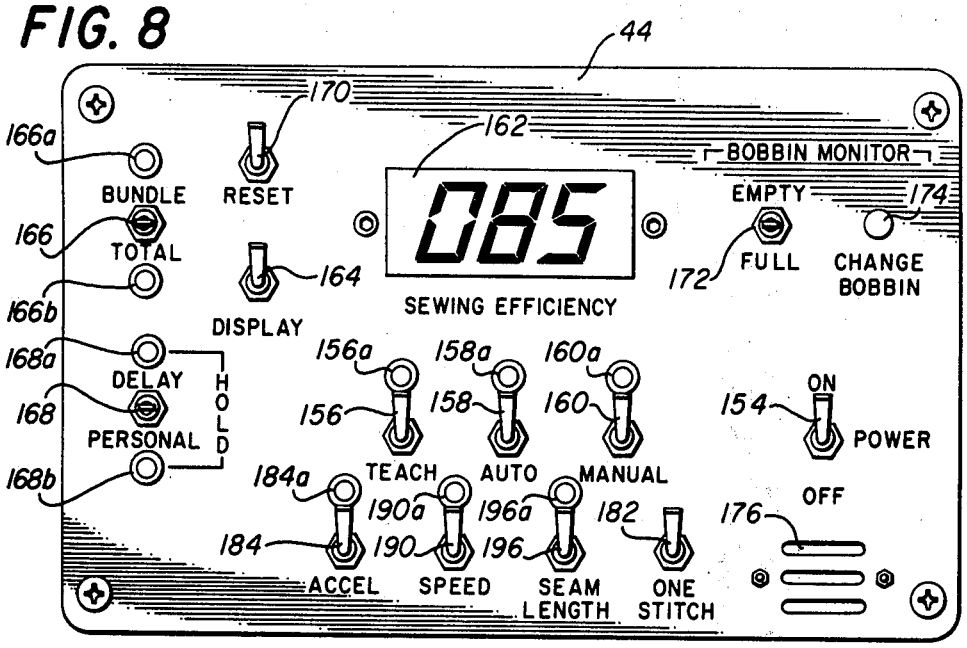
FIG. 8 is a front view of the main control panel.
Figure 9:
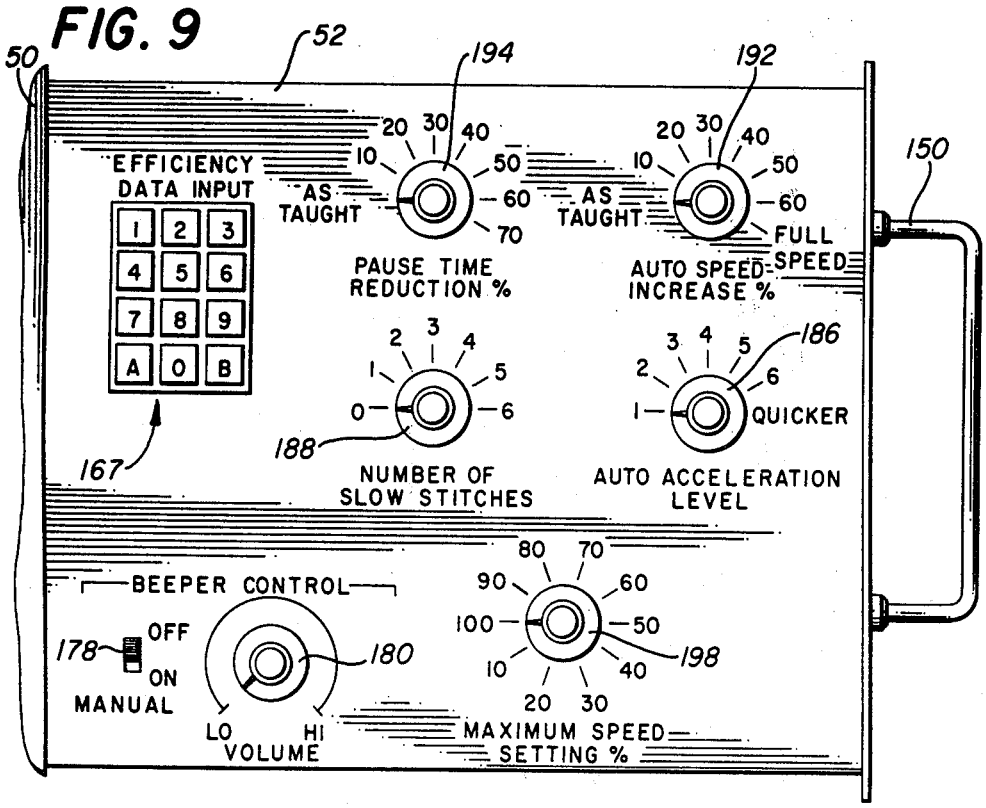
FIG. 9 is a front view of the auxiliary control panel.

The controls for sewing system 10, other than the manual controls associated with sewing machine 12, are found on operator or main control panel 44 and auxiliary control panel 52 shown in FIGS. 8 and 9. The primary controls are located on main panel 44 while auxiliary panel 52 contains adjustment controls. Panel 52 is normally closed within chassis 50, however, the panel can be pulled to an open position by means of handle 150 when adjustments are desired.

With reference to FIG. 8 in particular, main control panel 44 includes a power switch 154 to energize system 10. Switches 158, 156 and 160 are provided for respectively selecting the desired mode of operation. Lamps 156*a*, 158*a* and 160*a* are associated respectively with mode switches 156, 158 and 160 for indicating the particular mode selected.

A three-digit display 162 and associated switch 164 are provided for displaying the operator sewing efficiency being achieved or a predetermined error code upon detection of a malfunction. System 10 computes and displays the percentage sewing efficiency using as a reference the sewing time standard established for the particular sewing operation. Time lost for personal or delay reasons is also recorded and displayed. Switch 166 allows the operator to select the desired efficiency base with lamp 166*a* indicating selection of efficiency per bundle sewn, and with lamp 166*b* indicating selection of total efficiency for a desired period. Hold switch 168 can be moved to the delay or personal positions as indicated by lamps 168*a* and 168*b*, respectively, to interrupt computation of efficiency readings during thread breakage, machine delays, etc. Efficiency computation ceases while hold switch 168 is activated, and the amount of personal or delay time accumulated by the microprocessor controller 51 appears on display 162.

Switch 170 comprises an efficiency reset switch allowing the operator to clear and reset the sewing efficiency values. If switch 166 is set to bundle, activation of reset switch 170 will clear and reset only the bundle efficiency value and the total values will not be affected. If switch 166 is set to total, actuation of reset switch 170 will clear and reset both the bundle and total efficiency values.

Switch 172 on control panel 44 is provided for controlling the bobbin-monitoring capability of system 10. This is done by programming microprocessor controller 51 with the number of switches required to empty a full bobbin in sewing machine 12. Upon installation of a full bobbin, the operator can move switch 172 to the full position and then use sewing machine 12 in any one of the three modes. Upon depletion of the bobbin, switch 172 is then moved to the empty position to terminate counting with the number of stitches required to empty the bobbin. The microprocessor controller 51 thereafter monitors the number of stitches sewn and illuminates lamp 174 and activates a horn behind grill 176 on panel 44 when the stitch count reaches a predetermined percentage of the stored value to signal the need to change the bobbin.

Main control panel 44 also includes a one-stitch switch 182 to complement foot switch 38 shown in FIG. 1. Switch 182 can be used in any one of the three operational modes of system 10. Actuation of switch 182 will cause sewing machine 12 to sew a single stitch and leave needle 22 in the down position.

Referring now to FIGS. 8 and 9 together, system 10 includes several controls for further adjusting the operating characteristics of sewing machine 12. Switch 184 can be depressed in the auto mode of operation to modify acceleration and deceleration rates programmed into system 10 in the teach mode. When sewing in the auto mode with switch 184 actuated, which is indicated by lamp 184*a*, microprocessor controller 51 accelerates or decelerates sewing machine 12 via drive unit 42 in accordance with the rates programmed into system 10 in the teach mode. When switch 184 is not actuated, the acceleration and deceleration rates can be changed with rotary switch 186 located on auxiliary panel 52. In addition, a second rotary switch 188 located on panel 52 allows selection of the desired number of slow speed stitches at the beginning of each seam in the auto mode to reduce thread pull-out and other problems at the start of a seam. When switch 184 is reactuated in the auto mode, system 10 reverts to the acceleration rates orginally programmed into microprocessor controller 51.

Switch 190 can be depressed in the auto mode of operation to modify sewing speeds programmed into system 10 in the teach mode. When switch 190 is activated in the auto mode, which is indicated by lamp 190*a*, the speed of the sewing machine 12 can be varied by operation of foot treadle 28. When switch 190 is deactivated, the foot treadle 28 acts as an on/off switch such that the speed of sewing machine 12 in the auto mode, with the foot treadle fully depressed, will follow the speed profile sewn in the teach mode. Rotary switch 192 permits the operator to select the amount of speed up in the auto mode over the speed profile programmed during the teach mode. In addition, a second rotary switch 194 permits selective reduction of the sewing pause and presser foot up time intervals over the programmed intervals.

Switch 196 permits the operator to regain manual control of sewing machine 12 in the auto mode of operation. System 10 utilizes a combination of stitch counting and edge detection techniques to control seam lengths and end points; however, there may be situations where the operator anticipates material handling or other difficulties with certain seams. Actuation of switch 196 in the auto mode, coupled with removal of pressure from foot treadle 28, causes system 10 to revert to the manual mode so that the operator can manually complete the seam. System 10 will remain in the manual mode until the operator can manually complete the seam and raise presser foot 24. When presser foot 24 is lowered again and foot treadle 28 is depressed, system 10 will automatically revert to the auto mode and resume sewing of the next seam as programmed. Depression of switch 186 in the teach mode functions to program a command into microprocessor controller 51 at that point along the seam to subsequently invoke the seam length control function in the auto mode so that the seam can be completed manually. Lamp 196*a* indicates actuation of switch 196.

Referring only to FIG. 9, auxiliary control panel 52 further includes a rotary switch 198 for reducing maximum speed of sewing machine 12 in the manual, teach, and auto modes of operation to facilitate the training of operators for system 10.

System 10 operates as follows. Actuation of switch 154 on control panel 44 energizes sewing system 10. Sewing machine 12 can be operated manually by depressing switch 160 and manipulating the hand wheel 26, foot treadle 28, and switches 19, 32, 34 and 38 to control the sewing machine. Foot treadle 28 functions as an accelerator in the manual mode to control the sewing speed of machine 12.

When it is desired to program system 10 with a particular sewing procedure, the teach mode of operation can be selected with switch 156. Typically, this is done before beginning a bundle of pieces of similar sizes and/or shapes. As the first piece is sewn manually by the operator, the microprocessor controller 51 records and stores the following:

(a) number of stitches X and Y sewn in each seam and the status of sensors 40 at the end of the seam;

(b) sewing speed for each stitch;

(c) lifting and lowering of presser foot 24 as a function of stitch count;

(d) time duration during which presser foot 24 is lifted;

(e) operation of reverse sew switch 32 as a function of stitch count;

(f) time duration of any pauses in the sewing operation;

(g) actuation of the thread trimmer and thread wiper as a function of stitch count; and (h) actuation of a plurality of other auxiliary control devices, such as a zig-zag activation switch or throwout mechanisms of split needle bar machines, as a function of stitch count.

This information is utilized by the microprocessor controller 51 to automatically control operation of sewing machine 12 in the auto mode of system 10. Single stitches sewn at the end of each seam by depression of one-stitch switch 38 or switch 182 are simply added to the taught stitch count. At the completion of each single stitch, needle 24 is left in the down position. Manually entered single stitches, but not the pauses therebetween, are added to the stored seam stitch count. Thus pauses between the single stitches manually entered in the teach mode are ignored by microprocessor controller 51 later in the auto mode such that sewing machine 12 continues at constant speed through the manually entered stitches and then stops, thereby facilitating the teaching of new operators.

After manual completion of the first piece, switch 158 can be actuated to place system 10 in the auto mode for semi-automatic sewing of the remaining pieces. The operator positions the next piece for sewing of the first seam thereof, and then depresses foot treadle 28 to initiate control of sewing machine 12 by the microprocessor. Foot treadle 28 in the auto mode simply functions as an on/off switch with operation of sewing machine 12 being controlled by microprocessor 51. Depression of foot treadle 28 thus causes repeat of the programmed sewing operation as the operator continues to handle and guide the material through sewing machine 12. In the auto mode, the microprocessor controller 51 does not slow sewing machine 12 or pause between stitches which were added in the teach mode by depression of one-stitch switches 38 or 182. Rather, a substantially constant sewing speed, as modified by switch 190, is maintained as the sewing machine approaches the end of each seam, thereby saving considerable time. Release of foot treadle 28 interrupts the automatic sewing sequence.

A significant feature of system 10 is the fact that microprocessor 51 is programmed to set up a window in which the change in status of sensors 40 is expected, thereby eliminating spurious signals. For example, this window can be defined as 75–105% of the stitch count at the time of the last status change in sensors 40 before the end of the seam, which stitch count is represented by X in FIG. 5. Thus, microprocessor controller 51 does not begin to look for the characteristic pattern of sensors 40, and the controller is not responsive to a change in sensor status, until 75% of X stitches have been sewn. When sensors 40 change to their characteristic pattern for that seam, Y-X terminal stitches are sewn to end the seam at a precise point. If the characteristic sensor pattern is not detected within the window defined by 0.75X–1.05 X, microprocessor 51 automatically reverts to overall stitch counting for determining seam length and stops sewing machine 12 after Y stitches. Inaccuracies due to stitch counting therefore are reduced to a very small portion of the seam length.

It is advantageous to have a relatively wide window surrounding the stitch count at which a change in sensor status is expected. This permits system 10 to be programmed in the teach mode with a piece of given size to thereafter sew smaller size pieces of the same type in the auto mode without reprogramming the sewing operation. A relatively narrow window, such as 95–105% of X stitches works satisfactorily with pieces of the same size; however, since the transition to the characteristic pattern of sensors 40 on a relatively smaller piece of the same type might not appear in the window, the system would begin the countdown of Y-X stitches at the beginning of the window rather than at the point where the transition actually occurred resulting in an inaccurate seam end point. Thus, another aspect of the adaptive nature of semi-automatic sewing system 10 involves the fact that a sequence of sewing operations taught in the teach mode with a particular piece of one size can be utilized in the auto mode to sew similar pieces of other sizes without reprogramming.

Figure 10:
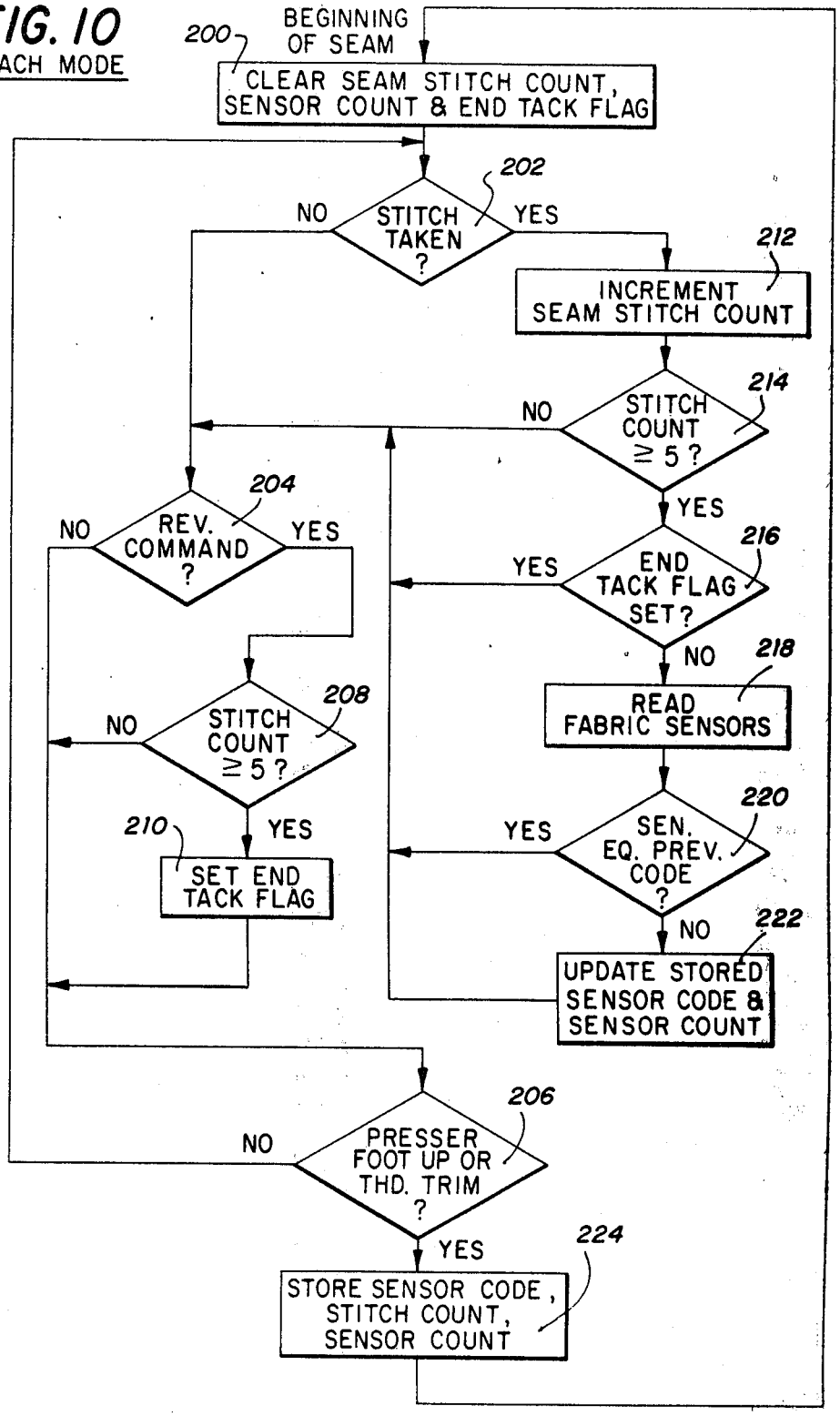
FIG. 10 is a diagram of the control logic of the system in the teach mode.
Figure 11:
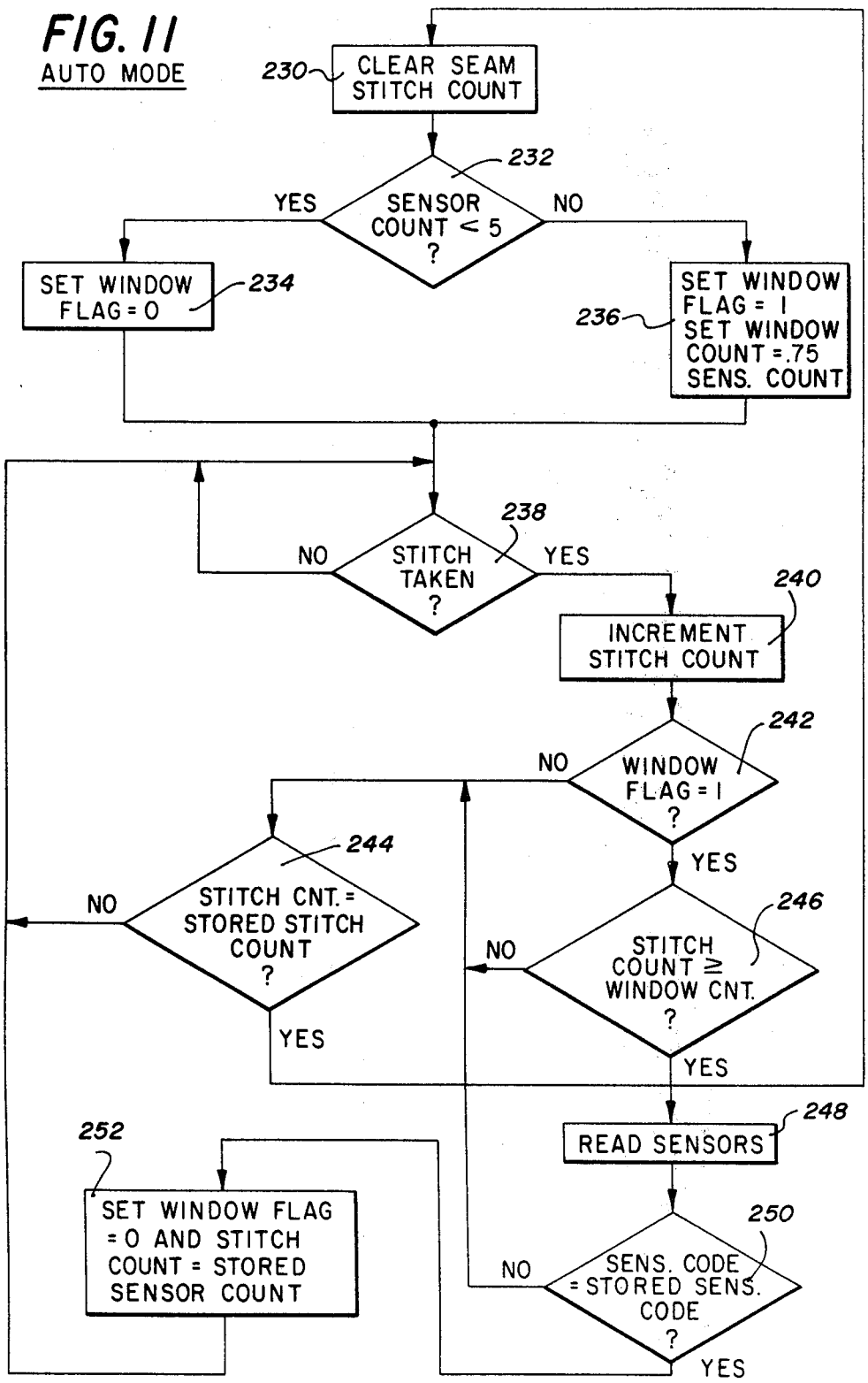
FIG. 11 is a diagram of the control logic of the system in the auto mode.

Referring now to FIGS. 10 and 11, there are shown the flowcharts of the control logic utilized by sensors 40 in the teach and auto modes of system 10. In the flowcharts, the term sensor code means the on/off condition of sensors 40. The term stitch count means the number of stitches taken in a seam. The term sensor count means the number of stitches at the last change in the sensor code. The term window means the zone in which microprocessor 51 is looking for a sensor code corresponding to the programmed sensor code.

Referring to FIG. 10 in particular, the teach mode control logic for each seam begins at 200 by clearing the seam stitch count, sensor count and end tack flag. An inquiry is made at 202 whether a stitch has been taken. If no stitch has been taken, an inquiry is made at 204 whether a reverse command has been received by sewing machine 12. If no stitch has been taken and there has been no reverse command, an inquiry is made at 206 whether pressure foot 24 is up or whether the tread has been trimmed. If no stitch has been taken and there has been a reverse command, an inquiry about the stitch count is made at 208. If the stitch count is less than five the progam proceeds directly to 206. If the stitch count is five or more, the end tack flag is set at 210 before proceeding to 206.

If a stitch has been taken, the stitch count is incremented at 212 before an inquiry about the stitch count is made at 214. If the stitch count is five or more, an inquiry is made at 216 as to whether the end tack flag is set. If the end tack flag is not set, fabric sensors 40 are read at 218 before an inquiry is made at 220 whether the condition or code of sensors 40 matches the previous code. If not, then the stored sensor code and sensor count are updated at 222 before proceeding to 204. Depending upon the position of pressure foot 24 or the status of the thread trimmer at 206, the program may go back to 202 or store the sensor code, stitch count and sensor count at 224 before returning to 200.

A sample program listing the microprocessor controller 51 of system 10 in the teach mode is set forth below. The program is particularly adapted for a Zilog Z-80 microprocessor, and is written in Z-80 assembly language in accordance with the Z-80 CPU Manual available from the Zilog Corporation. The program is subdivided into tables as follows:

| TABLE | TEACH MODE PROGRAM |
|---|---|
| 1 | Clearing |
| 2 | Sewing |
| 3 | Storing. |

TABLE 1

```
(006F'   CD 0000*        00670          CALL    RBSMCL          ;CLR CNTRS & END TACK FLG
                         06770   ;
                         06780   ;  ROUTINE TO CLEAR SEAM STITCH COUNTERS AND END TACK FLG
                         06790   ;
03F9'    21 0000         06800   RBSMCL::LD      HL,0
03FC'    22 005A!        06810           LD      (SMSTCT),HL
03FF'    22 005C!        06820           LD      (FBSNCT),HL
0402'    21 003F!        06830           LD      HL,TCHFL
0405'    CB 9E           06840           RES     3,(HL)
0407'    C9              06850           RET
                         06860           PAGE
```

TABLE 2

```
03BA'    21 003C!        04010   RS006A: LD      HL,NDLFLG       ;NDL DN INTR ?
03BD'    CB 46           04020           BIT     0,(HL)
03BF'    28 49           04030           JR      Z,RS006B        ;NO
03C1'    CB 86           04040           RES     0,(HL)          ;YES
03C3'    4F              04050           LD      C,A             ;SAVE TRDL CNT
03C4'    2A 0062!        04060           LD      HL,(SGSTCH)     ;INCR SEG STCH CNT
03C7'    23              04070           INC     HL
03C8'    22 0062!        04080           LD      (SGSTCH),HL
03CB'    2A 005A!        04090           LD      HL,(SMSTCT)     ;INCR SEAM STCH CNT
03CE'    23              04100           INC     HL
03CF'    22 005A!        04110           LD      (SMSTCT),HL
03D2'    ED 5B 0000*     04120           LD      DE,(FSCNT)      ;IS SM. ST. CT G.T.E. MIN
03D6'    B7              04130           OR      A
03D7'    ED 52           04140           SBC     HL,DE
03D9'    38 0A           04150           JR      C,RS006C        ;NO - NO ACTION
03DB'    21 003F!        04160           LD      HL,TCHFL        ;YES, IS END TACK FL SET?
03DE'    CB 5E           04170           BIT     3,(HL)
03E0'    20 03           04180           JR      NZ,RS006C       ;YES - NO ACTION
03E2'    CD 0000*        04190           CALL    RRFS            ;NO - READ FAB SNSRS
03E5'    21 00F7!        04200   RS006C: LD      HL,LSTSPD
03E8'    79              04210           LD      A,C             ;RESTORE TRDL CNT
03E9'    BE              04220           CP      (HL)            ;NEW CMD = OLD ?
03EA'    28 05           04230           JR      Z,RS006D        ;YES
03EC'    CD 0000*        04240           CALL    RWRST           ;NO
03EF'    18 19           04250           JR      RS006B
03F1'    3A 0064!        04260   RS006D: LD      A,(MLSTCH)      ;INCR. MULT. ST. CNT
03F4'    3C              04270           INC     A
03F5'    32 0064!        04280           LD      (MLSTCH),A
03F8'    CB 6F           04290           BIT     5,A             ;CNT G.T. 31 ?
03FA'    28 0E           04300           JR      Z,RS006B        ;NO
03FC'    7E              04310           LD      A,(HL)          ;YES - WRITE MULT ST. CMD
03FD'    F6 80           04320           OR      80H
03FF'    57              04330           LD      D,A
0400'    1E 1F           04340           LD      E,1FH
0402'    CD 0000*        04350           CALL    RWRCMD
0405'    3E 01           04360           LD      A,1             ;RST MULT ST. CNT TO 1
0407'    32 0064!        04370           LD      (MLSTCH),A
040A'    21 003B!        04380   RS006B: LD      HL,FLAGS
040D'    CB 76           04390           BIT     6,(HL)          ;REV. SW. OPER. ?
040F'    28 43           04400           JR      Z,RS006E        ;NO
0411'    CB B6           04410           RES     6,(HL)          ;YES
0413'    21 00F7!        04420           LD      HL,LSTSPD
0416'    7E              04430           LD      A,(HL)
0417'    CD 0000*        04440           CALL    RWRST           ;WRITE PENDING ST. CMD
041A'    3E 00           04450           LD      A,0
041C'    32 0064!        04460           LD      (MLSTCH),A
041F'    DB 01           04470           IN      A,(1)           ;WHICH WAY ?
0421'    CB 57           04480           BIT     2,A
0423'    3A 0095!        04490           LD      A,(CMNDS)
0426'    28 1E           04500           JR      Z,RS006F        ;FORWARD
0428'    F6 02           04510           OR      02H             ;CMND REV
042A'    CD 0000*        04520           CALL    ROUTCD
```

TABLE 2 cont'd

```
042D'   CD 0000*        04530          CALL    RSETAL          ;SET ALARM
0430'   2A 005A!        04540          LD      HL,(SMSTCT)     ;IS SM. ST. CT G.T.E. MIN
0433'   ED 5B 0000*     04550          LD      DE,(FSCNT)
0437'   B7              04560          OR      A
0438'   ED 52           04570          SBC     HL,DE
043A'   38 05           04580          JR      C,RS006G        ;NO
043C'   21 003F!        04590          LD      HL,TCHFL        ;YES, SET END TACK FLAG
043F'   CB DE           04600          SET     3,(HL)
0441'   11 A000         04610  RS006G: LD      DE,0A000H       ;WRITE REV CMD
0444'   18 08           04620          JR      RS006H
0446'   E6 FD           04630  RS006F: AND     0FDH            ;CMND FOR
0448'   CD 0000*        04640          CALL    ROUTCD
044B'   11 A100         04650          LD      DE,0A100H       ;WRITE FORWARD CMD
044E'   CD 0000*        04660  RS006H: CALL    RWRCMD
0451'   C3 050B'        04670          JP      RS006I
                        06870  ;
                        06880  ;  ROUTINE TO READ FABRIC SENSORS AND COMPARE TO PREVIOUS
                        06890  ;       VALUE AND SAVE IF DIFFERENT
                        06900  ;
0408'   3E 28           06910  RRFS:   LD      A,0500          ;READ SENSORS
040A'   D3 02           06920          OUT     (2),A
040C'   DB 07           06930          IN      A,(7)
040E'   E6 70           06940          AND     70H
0410'   47              06950          LD      B,A             ;SAVE
0411'   DB 07           06960  RRFS2:  IN      A,(7)           ;READ AGAIN TO BE SURE
0413'   E6 70           06970          AND     70H
0415'   B8              06980          CP      B
0416'   28 03           06990          JR      Z,RRFS3         ;OK
0418'   47              07000          LD      B,A             ;DON'T AGREE, READ AGAIN
0419'   18 F6           07010          JR      RRFS2
041B'   06 04           07020  RRFS3:  LD      B,4
041D'   CB 3F           07030  RRFS1:  SRL     A
041F'   10 FC           07040          DJNZ    RRFS1
0421'   21 0060!        07050          LD      HL,FBSNCD       ;COMPARE TO OLD VALUE
0424'   BE              07060          CP      (HL)
0425'   C8              07070          RET     Z               ;SAME - NO ACTION
0426'   77              07080          LD      (HL),A          ;DIFFERENT - SAVE NEW
0427'   2A 005A!        07090          LD      HL,(SMSTCT)     ;SAVE SEAM STCH CNT
042A'   22 005C!        07100          LD      (FBSNCT),HL
042D'   C9              07110          RET
                        07120          PAGE
```

TABLE 3

```
                        00390  ;
                        00400  ;  TEACH MODE - PAUSED
                        00410  ;
0030'   DB 01           00420  RST004:IN       A,(1)           ;IS P.F. DOWN ?
0032'   CB 67           00430         BIT      4,A
0034'   C2 0246'        00440         JP       NZ,RS004R       ;NO
0037'   CD 0000*        00450         CALL     RRDFTR          ;YES - READ FT TRDL
003A'   21 0000*        00460         LD       HL,FTHYST
003D'   BE              00470         CP       (HL)
003E'   DA 0097'        00480         JP       C,RS04KK        ;L.T. HYST.
0041'   32 004F!        00490         LD       (SD),A          ;SET SPD = TRDL CNT
0044'   21 003F!        00500         LD       HL,TCHFL        ;PAUSE DELETE FLG SET ?
0047'   CB 66           00510         BIT      4,(HL)
0049'   28 0E           00520         JR       Z,RS004I        ;NO
004B'   CB A6           00530         RES      4,(HL)          ;YES - RESET IT
004D'   2A 0054!        00540         LD       HL,(LSTNPC)     ;BACK UP TO LAST NON-PAUSE
0050'   23              00550         INC      HL
0051'   22 0054!        00560         LD       (LSTNPC),HL
0054'   22 0050!        00570         LD       (NXTCMD),HL
0057'   18 03           00580         JR       RS0040
0059'   CD 0000*        00590  RS004I: CALL    RWRPAU          ;WRITE PAUSE
005C'   CD 0000*        00600  RS0040: CALL    RPTOFF          ;DISABLE & CLR PAUSE TMR
005F'   21 003F!        00610         LD       HL,TCHFL
0062'   CB 46           00620         BIT      0,(HL)          ;START PC. FLG SET ?
0064'   28 0E           00630         JR       Z,RS004B        ;NO
0066'   CD 0000*        00640         CALL     RINIEF          ;YES - FORCE BNDL OR TTL
0069'   CD 0000*        00650         CALL     REFFBP          ;CALC. EFF.
006C'   CD 0000*        00660  RS004E: CALL    RWNBSM          ;WRITE NEW BEG. SM.
006F'   CD 0000*        00670         CALL     RBSMCL          ;CLR CNTRS & END TACK FLG
0072'   18 0F           00680         JR       RS004C
0074'   CB 4E           00690  RS004B: BIT     1,(HL)          ;IS STRT SM FLG SET ?
0076'   28 08           00700         JR       Z,RS004D        ;NO
0078'   CD 0000*        00710         CALL     RBSMFL          ;YES-FILL IN LAST BEG. SM
007B'   CD 0000*        00720         CALL     RBSFIL          ;FILL IN LAST BEG. SEG.
007E'   18 EC           00730         JR       RS004E
0080'   CD 0000*        00740  RS004D: CALL    RBSFIL
0083'   21 003F!        00750  RS004C: LD      HL,TCHFL        ;CLR START SM., PC. FLAGS
0086'   CB B6           00760         RES      0,(HL)
0088'   CB BE           00770         RES      1,(HL)
008A'   CD 0000*        00780         CALL     RWNBSG          ;WRITE NEW BEGIN SEG.
```

TABLE 3 cont'd

```
008D'   21 003E!        00790          LD      HL,CTLFL        ;CLR JOG FLAG
0090'   CB B6           00800          RES     6,(HL)
0092'   0E 05           00810          LD      C,5             ;GO TO SEWING - WAITING
0094'   C3 0000*        00820          JP      RSTCHG
                        06100  ;
                        06110  ;  ROUTINE TO INSERT FABRIC SENSOR CODE AND SEAM STITCH
                        06120  ;      COUNT INTO BEGIN SEAM COMMAND
                        06130  ;
039A'   2A 005B!        06140  RBSMFL::LD      HL,(BSMPTR)
039D'   3A 0060!        06150          LD      A,(FBSNCD)      ;GET FABRIC SENSOR CODE
03A0'   CB 27           06160          SLA     A
03A2'   CB 27           06170          SLA     A
03A4'   B6              06180          OR      (HL)
03A5'   77              06190          LD      (HL),A          ;STORE
03A6'   E5              06200          PUSH    HL              ;SAVE BEG. SEAM PNTR
03A7'   2A 005A!        06210          LD      HL,(SMSTCT)     ;FBSNCT G.T.E. SMSTCT
03AA'   ED 5B 005C!     06220          LD      DE,(FBSNCT)
03AE'   37              06230          SCF
03AF'   ED 52           06240          SBC     HL,DE
03B1'   30 01           06250          JR      NC,RBSMF2       ;NO
03B3'   1B              06260          DEC     DE              ;YES - MAKE L.T. SMSTCT
03B4'   E1              06270  RBSMF2: POP     HL
03B5'   4B              06280          LD      C,E             ;SAVE LSB
03B6'   7A              06290          LD      A,D             ;GET UPPER 2 BITS
03B7'   E6 0C           06300          AND     0CH
03B9'   CB 3F           06310          SRL     A
03BB'   CB 3F           06320          SRL     A
03BD'   B6              06330          OR      (HL)            ;STORE
03BE'   77              06340          LD      (HL),A
03BF'   23              06350          INC     HL
03C0'   7A              06360          LD      A,D             ;GET MIDDLE 5 BITS
03C1'   E6 03           06370          AND     3
03C3'   57              06380          LD      D,A
03C4'   06 03           06390          LD      B,3
03C6'   CB 23           06400  RBSMF1: SLA     E
03C8'   CB 12           06410          RL      D
03CA'   10 FA           06420          DJNZ    RBSMF1
03CC'   7A              06430          LD      A,D
03CD'   B6              06440          OR      (HL)            ;STORE MID BITS
03CE'   77              06450          LD      (HL),A
03CF'   23              06460          INC     HL
03D0'   79              06470          LD      A,C             ;GET LOWER 5 BITS
03D1'   E6 1F           06480          AND     1FH
03D3'   B6              06490          OR      (HL)
03D4'   77              06500          LD      (HL),A          ;STORE
03D5'   C9              06510          RET
                        06520          PAGE
```

Referring particularly to FIG. 11, the control logic in the auto mode begins by clearing the seam stitch count at 230 before checking the sensor count at 232. If the sensor count is less than five, the window flag is set to zero at 234. If the sensor count is five or more, the window flag is set to one and the window count is set to 0.75 of the sensor count at 236. An inquiry is then made at 238 whether a stitch has been taken, and if not, the system continues looking for a stitch. If a stitch has been taken, the stitch count is incremented at 240 before checking the window flag at 242. If the window flag is zero and thus not equal to one, the stitch count is compared to the stored stitch count at 244, after which the program may go to 238 or 230. If the window flag equals one, the stitch count is compared to the window count at 246. Should the stitch count be less than the window count, the program then goes to 244. Should the stitch count be equal to or greater than the window count, sensors 40 are then read at 248 before comparing the sensor code to the stored sensor code at 250. If the sensor code does not match the stored sensor code, the program proceeds to 244. Should the sensor code match the stored sensor code, the window flag is set to zero and the stitch count is set to the stored sensor count at 252 before proceeding back to 238.

A program listing for the microprocessor controller 51 of system 10 in the auto mode is set forth below. The program is particularly adapted for a Zilog Z-80 microprocessor, and is written in Z-80 assembly language in accordance with the Z-80 CPU Manual available from Zilog Corporation. The program is subdivided tables as follows:

| TABLE | AUTO MODE PROGRAM |
|---|---|
| 4 | Clearing and initialization |
| 5 | Sewing |
| 6 | Adjustment |

TABLE 4

```
00B1'  21 0040!     01060  RBGSM:  LD    HL,AUTOFL      ;OP. ASST. EXIT SET ?
00B4'  CB 7E        01070          BIT   7,(HL)
00B6'  20 04        01080          JR    NZ,RBGSM2      ;YES
00B8'  CB 96        01090          RES   2,(HL)         ;NO - RST P.T. FLAG
00BA'  CB 9E        01100          RES   3,(HL)         ;RST S.T. FLAG
00BC'  2A 0050!     01110  RBGSM2: LD    HL,(NXTCMD)
00BF'  7A           01120          LD    A,D            ;GET FABRIC SENSOR CODE
00C0'  E6 1C        01130          AND   1CH
00C2'  CB 3F        01140          SRL   A
00C4'  CB 3F        01150          SRL   A
00C6'  32 0060!     01160          LD    (FBSNCD),A     ;SAVE CODE
00C9'  7A           01170          LD    A,D            ;GET SNSR CHANGE STCH CNT
00CA'  E6 03        01180          AND   3
00CC'  57           01190          LD    D,A
00CD'  7E           01200          LD    A,(HL)
00CE'  CB 27        01210          SLA   A
       CB 27        01220          SLA   A
       CB 27        01230          SLA   A
       5F           01240          LD    E,A
       CB 23        01250          SLA   E
       CB 12        01260          RL    D
       CB 23        01270          SLA   E
       CB 12        01280          RL    D
       23           01290          INC   HL
       7E           01300          LD    A,(HL)
       23           01310          INC   HL
       22 0050!     01320          LD    (NXTCMD),HL
       B3           01330          OR    E
       5F           01340          LD    E,A
       21 0000      01350          LD    HL,0           ;CLR SEAM STITCH CNT
       22 005A!     01360          LD    (SMSTCT),HL
       B7           01370          OR    A              ;IS FAB. SNSR. CNT = 0 ?
       ED 52        01380          SBC   HL,DE
       28 24        01390          JR    Z,RBGSM3       ;YES - NO WINDOW ENABLE
       2A 0000*     01400          LD    HL,(FSCNT)     ;NOT 0, IS IT L.T. MIN. ?
       37           01410          SCF
       ED 52        01420          SBC   HL,DE
       30 1C        01430          JR    NC,RBGSM3      ;LESS THAN MINIMUM
       21 0040!     01440          LD    HL,AUTOFL      ;SET WINDOW ENABLE FLAG
       CB F6        01450          SET   6,(HL)
       ED 53 005C!  01460          LD    (FBSNCT),DE
       D5           01470          PUSH  DE             ;CALC. WINDOW CNT
       E1           01480          POP   HL
       06 02        01490          LD    B,2
       CB 3A        01500  RBGSM1: SRL   D
       CB 1B        01510          RR    E
       10 FA        01520          DJNZ  RBGSM1
       B7           01530          OR    A
       ED 52        01540          SBC   HL,DE
       22 005E!     01550          LD    (FBSNWC),HL    ;SAVE WINDOW CNT
       C3 0000*     01560          JP    RBKGRD
       21 0040!     01570  RBGSM3: LD    HL,AUTOFL      ;RST WINDOW FLAG
       CB B6        01580          RES   6,(HL)
       C3 0000*     01590          JP    RBKGRD
```

TABLE 5

```
                    01360  ;
                    01370  ;  AUTO - SEWING TAUGHT PROFILE
                    01380  ;
0105'  21 003C!     01390  RST02B::LD    HL,NDLFLG      ;NEEDLE DOWN INTR. ?
0108'  CB 46        01400          BIT   0,(HL)
010A'  28 40        01410          JR    Z,RS028A       ;NO
010C'  CD 0000*     01420          CALL  RGETST         ;YES - GET NEXT STITCH
                    01000  ;
                    01010  ;  ROUTINE TO DECODE ANOTHER STITCH CMD IN AUTO MODE
                    01020  ;
008B'  CB 86        01030  RGETST::RES   0,(HL)          ;RESET NEEDLE DOWN INTR.
008D'  2A 005A!     01040          LD    HL,(SMSTCT)    ;INCR. SEAM STITCH CNT
0090'  23           01050          INC   HL
0091'  22 005A!     01060          LD    (SMSTCT),HL
0094'  2A 00A1!     01070          LD    HL,(SEGCNT)    ;DECR. SEGMENT CNT
0097'  11 0001      01080          LD    DE,1
009A'  B7           01090          OR    A
009B'  ED 52        01100          SBC   HL,DE
009D'  28 13        01110          JR    Z,RGET15       ;SEG. CNT = 0
009F'  38 11        01120          JR    C,RGET15       ;SEG. CNT = -1
00A1'  22 00A1!     01130          LD    (SEGCNT),HL    ;SEG. CNT G.T.E. 2
00A4'  3A 00A3!     01140          LD    A,(STCHCT)     ;GET CNT OF STCHS DECODED
00A7'  3D           01150          DEC   A
00A8'  32 00A3!     01160          LD    (STCHCT),A
00AB'  FE 00        01170          CP    0              ;OUT OF DECODED STCHS ?
00AD'  C2 016C'     01180          JP    NZ,RGETS1      ;NO
00B0'  18 07        01190          JR    RGETS2         ;YES
00B2'  21 0000      01200  RGET15: LD    HL,0           ;SET SEG. CNT = 0
```

TABLE 5 cont'd

```
00B5'   22 00A1!        01210          LD      (SEGCNT),HL
00B8'   C9              01220          RET                     ;RETURN
00B9'   2A 0050!        01230  RGETS2: LD      HL,(NXTCMD)     ;DECODE NEXT CMD
00BC'   7E              01240          LD      A,(HL)
00BD'   23              01250          INC     HL
00BE'   22 0050!        01260          LD      (NXTCMD),HL
00C1'   57              01270          LD      D,A             ;SAVE CMD
00C2'   E6 E0           01280          AND     0E0H            ;GET CMD CODE
00C4'   FE 60           01290          CP      60H
00C6'   20 11           01300          JR      NZ,RGETS3
00C8'   3E 01           01310          LD      A,1             ;SINGLE STITCH
00CA'   32 00A3!        01320  RGETS5: LD      (STCHCT),A
00CD'   32 0061!        01330          LD      (LSSTCT),A
00D0'   7A              01340          LD      A,D
00D1'   E6 1F           01350          AND     1FH
00D3'   32 00A0!        01360          LD      (AUTSPD),A
00D6'   C3 016C'        01370          JP      RGETS1
00D9'   FE 80           01380  RGETS3: CP      80H
00DB'   20 0C           01390          JR      NZ,RGETS4
00DD'   2A 0050!        01400          LD      HL,(NXTCMD)     ;MULTIPLE STITCH
00E0'   7E              01410          LD      A,(HL)
00E1'   23              01420          INC     HL
00E2'   22 0050!        01430          LD      (NXTCMD),HL
00E5'   E6 1F           01440          AND     1FH
00E7'   18 E1           01450          JR      RGETS5
00E9'   FE A0           01460  RGETS4: CP      0A0H
00EB'   20 75           01470          JR      NZ,RGETS6       ;NOT A VALID CMD
00ED'   7A              01480          LD      A,D             ;MISC. CMDS
00EE'   E6 0F           01490          AND     0FH             ;GET CODE
00F0'   FE 00           01500          CP      0
00F2'   20 0A           01510          JR      NZ,RGETS7
00F4'   3A 0095!        01520          LD      A,(CMNDS)       ;REVERSE
00F7'   F6 02           01530          OR      02H
00F9'   CD 0000*        01540  RGETS9: CALL    ROUTCD
00FC'   18 BB           01550          JR      RGETS2          ;DECODE ANOTHER CMD
00FE'   FE 01           01560  RGETS7: CP      1
100'    20 08           01570          JR      NZ,RGETS8
102'    3A 0095!        01580          LD      A,(CMNDS)       ;FORWARD
105'    E6 FD           01590          AND     0FDH
107'    C3 00F9'        01600          JP      RGETS9
10A'    FE 05           01610  RGETS8: CP      5
10C'    20 0F           01620          JR      NZ,RGET16
10E'    21 0041!        01630          LD      HL,AUTOFL+1     ;OPERATOR ASSIST
111'    CB C6           01640          SET     0,(HL)
113'    3A 0065!        01650          LD      A,(LIGHTS)      ;TURN ON OP. ASST. LT.
116'    F6 08           01660          OR      08H
118'    CD 0000*        01670          CALL    ROUTLT
11B'    18 9C           01680          JR      RGETS2          ;DECODE ANOTHER CMD
11D'    FE 07           01690  RGET16: CP      7
11F'    20 07           01700          JR      NZ,RGET17
121'    21 0096!        01710          LD      HL,FCTS         ;EXT. FCT. 4 ON
124'    CB DE           01720          SET     3,(HL)
126'    18 35           01730          JR      RGET22
128'    FE 08           01740  RGET17: CP      8
12A'    20 07           01750          JR      NZ,RGET18
12C'    21 0096!        01760          LD      HL,FCTS         ;EXT. FCT. 4 OFF
12F'    CB 9E           01770          RES     3,(HL)
131'    18 2A           01780          JR      RGET22
133'    FE 09           01790  RGET18: CP      9
135'    20 07           01800          JR      NZ,RGET19
137'    21 0096!        01810          LD      HL,FCTS         ;EXT. FCT. 5 ON
13A'    CB E6           01820          SET     4,(HL)
13C'    18 1F           01830          JR      RGET22
13E'    FE 0A           01840  RGET19: CP      0AH
140'    20 07           01850          JR      NZ,RGET20
142'    21 0096!        01860          LD      HL,FCTS         ;EXT. FCT. 5 OFF
145'    CB A6           01870          RES     4,(HL)
147'    18 14           01880          JR      RGET22
149'    FE 0B           01890  RGET20: CP      0BH
14B'    20 07           01900          JR      NZ,RGET21
14D'    21 0096!        01910          LD      HL,FCTS         ;EXT. FCT. 6 ON
150'    CB EE           01920          SET     5,(HL)
152'    18 09           01930          JR      RGET22
154'    FE 0C           01940  RGET21: CP      0CH
156'    20 0A           01950          JR      NZ,RGETS6       ;NOT A VALID CMD
158'    21 0096!        01960          LD      HL,FCTS         ;EXT. FCT. 6 OFF
15B'    CB AE           01970          RES     5,(HL)
15D'    3A 0095!        01980  RGET22: LD      A,(CMNDS)
160'    18 97           01990          JR      RGETS9
162'    3E 10           02000  RGETS6: LD      A,16            ;ERROR - INVALID CMD
164'    32 00E4!        02010          LD      (ERRCD),A
167'    0E 32           02020          LD      C,50            ;GO TO ERROR STATES
169'    C3 0000*        02030          JP      RSTCHG
16C'    21 0040!        02040  RGETS1: LD      HL,AUTOFL       ;FAB. SNSR ENABLE FL SET?
16F'    CB 76           02050          BIT     6,(HL)
171'    20 04           02060          JR      NZ,RGET10       ;YES
173'    2A 00A1!        02070  RGET11: LD      HL,(SEGCNT)     ;NO - CONTINUE SEWING
176'    C9              02080          RET
177'    2A 005A!        02090  RGET10: LD      HL,(SMSTCT)     ;INCR. CNT OF STS. IN SM.
```

TABLE 5 cont'd

```
017A'   ED 5B 005E!   02100          LD      DE,(FBSNWC)     ;STS. SEWN G.T.E. WNDW ?
017E'   B7            02110          OR      A
017F'   ED 52         02120          SBC     HL,DE
0181'   38 F0         02130          JR      C,RGET11        ;NO - CONTINUE SEWING
0183'   3E 28         02140          LD      A,0500          ;YES - READ FABRIC SNSRS
0185'   D3 02         02150          OUT     (2),A
0187'   DB 07         02160          IN      A,(7)
0189'   E6 70         02170          AND     70H
018B'   47            02180          LD      B,A             ;SAVE
018C'   DB 07         02190  RGET13: IN      A,(7)           ;READ AGAIN TO BE SURE
018E'   E6 70         02200          AND     70H
0190'   B8            02210          CP      B
0191'   28 03         02220          JR      Z,RGET14        ;OK
0193'   47            02230          LD      B,A             ;DON'T AGREE, READ AGAIN
0194'   18 F6         02240          JR      RGET13
0196'   06 04         02250  RGET14: LD      B,4
0198'   CB 3F         02260  RGET12: SRL     A
019A'   10 FC         02270          DJNZ    RGET12
019C'   21 0060!      02280          LD      HL,FBSNCD       ;COMPARE TO FINAL CODE
019F'   AE            02290          XOR     (HL)
01A0'   20 D1         02300          JR      NZ,RGET11       ;NOT = , CONT. SEWING
01A2'   21 0040!      02310          LD      HL,AUTOFL       ;RST SNSR ENABLE FLAG
01A5'   CB B6         02320          RES     6,(HL)
01A7'   C3 01F3'      02330          JP      RFSINI          ;EQUAL, RESTART AT FBSNCT
                      02340          PAGE
```

TABLE 6

```
                      02940  ;  ROUTINE TO RESET STITCH COUNTERS AND TAUGHT COMMAND
                      02950  ;    POINTER TO STITCH AT WHICH FABRIC SENSOR CHANGE WAS
                      02960  ;    DETECTED DURING TEACH MODE
                      02970  ;
01F3'   CD 0335'      02980  RFSINI:CALL     RDECNC          ;DECR. PNTR TO PRESENT CM
01F6'   2A 005C!      02990  RFS1:   LD      HL,(FBSNCT)     ;PNTRS SET TO RIGHT STCH?
01F9'   ED 5B 005A!   03000          LD      DE,(SMSTCT)
01FD'   B7            03010          OR      A
01FE'   ED 52         03020          SBC     HL,DE
0200'   28 06         03030          JR      Z,RFS2          ;YES - NO ADJ. NEEDED
0202'   D2 024F'      03040          JP      NC,RFS3         ;NEED TO SKIP SOME STCHS
0205'   C3 02C0'      03050          JP      RFS4            ;NEED TO REPEAT SOME STS
0208'   CD 0326'      03060  RFS2:   CALL    RINCNC          ;INCR. PNTR TO NEXT CMD
020B'   2A 00A1!      03070          LD      HL,(SEGCNT)     ;IS SEG. CNT G.T. K ?
020E'   16 00         03080          LD      D,0
0210'   3A 0000*      03090          LD      A,(K)
0213'   5F            03100          LD      E,A
0214'   37            03110          SCF
0215'   ED 52         03120          SBC     HL,DE
0217'   30 10         03130          JR      NC,RFS5         ;YES
0219'   3E 00         03140  RFS17:  LD      A,0             ;NO - SET PLAT. SPD
021B'   32 004F!      03150          LD      (SD),A
021E'   21 003E!      03160          LD      HL,CTLFL        ;SET STOP OVERRIDE BIT
0221'   CB CE         03170          SET     1,(HL)
0223'   E1            03180          POP     HL              ;DUMMY RETURN
0224'   0E 1F         03190          LD      C,31            ;GO SEW PLATEAU SPD
0226'   C3 0000*      03200          JP      RSTCHG
0229'   3A 004E!      03210  RFS5:   LD      A,(SPSTA)       ;ALREADY IN DYN. BRAKE ?
022C'   FE 02         03220          CP      2
022E'   28 E9         03230          JR      Z,RFS17         ;YES
0230'   3A 0095!      03240          LD      A,(CMNDS)       ;INSURE NOT IN PLAT. MD
0233'   E6 07         03250          AND     07H
0235'   CD 0000*      03260          CALL    ROUTCD
0238'   3E 01         03270          LD      A,1
023A'   32 004E!      03280          LD      (SPSTA),A
023D'   3A 00A0!      03290          LD      A,(AUTSPD)      ;SET SPD = TAUGHT SPD
0240'   32 00EA!      03300          LD      (SPEED),A
0243'   CD 0000'      03310          CALL    RLSPIN          ;APPLY LRN SPD INCREASE
0246'   CD 0016'      03320          CALL    RSPDOR          ;APPLY SPD OVRD FACTOR
0249'   E1            03330          POP     HL              ;DUMMY RETURN
024A'   0E 1C         03340          LD      C,28            ;SEW TAUGHT PROFILE
024C'   C3 0000*      03350          JP      RSTCHG
024F'   2A 00A1!      03360  RFS3:   LD      HL,(SEGCNT)     ;SKIP A STITCH
0252'   2B            03370          DEC     HL
0253'   22 00A1!      03380          LD      (SEGCNT),HL
0256'   2A 005A!      03390          LD      HL,(SMSTCT)
0259'   23            03400          INC     HL
025A'   22 005A!      03410          LD      (SMSTCT),HL
025D'   3A 00A3!      03420          LD      A,(STCHCT)
0260'   3D            03430          DEC     A
0261'   32 00A3!      03440          LD      (STCHCT),A
0264'   20 90         03450          JR      NZ,RFS1         ;CHECK IF ENOUGH SKIPPED
0266'   CD 0326'      03460  RFS9:   CALL    RINCNC          ;GET NEXT TAUGHT CMD
0269'   7E            03470          LD      A,(HL)
026A'   57            03480          LD      D,A             ;SAVE IT
026B'   E6 E0         03490          AND     0E0H
026D'   FE 60         03500          CP      60H
026F'   28 1A         03510          JR      Z,RFS6          ;SINGLE STITCH
```

TABLE 6 cont'd

```
0271'   FE 80
0273'   28 24
0275'   FE 20
0277'   28 2E
0279'   FE 40
027B'   28 E9
027D'   FE A0
027F'   28 E5
0281'   3E 14
0283'   32 00E4!
0286'   0E 32
0288'   C3 0000*
028B'   7A
028C'   E6 1F
028E'   32 00A0!
0291'   3E 01
0293'   32 00A3!
0296'   C3 01F6'
0299'   7A
029A'   E6 1F
029C'   32 00A0!
029F'   23
02A0'   7E
02A1'   32 00A3!
02A4'   C3 01F6'
02A7'   7A
02A8'   E6 1F
02AA'   57
02AB'   1E 00
02AD'   06 03
02AF'   CB 3A
02B1'   CB 1B
02B3'   10 FA
02B5'   23
02B6'   7E
02B7'   B3
02B8'   5F
02B9'   ED 53 00A1!
02BD'   C3 0266'
02C0'   3A 0061!
02C3'   47
02C4'   3A 00A3!
02C7'   B8
02C8'   30 15
02CA'   2A 00A1!
02CD'   23
02CE'   22 00A1!
02D1'   2A 005A!
02D4'   2B
02D5'   22 005A!
02D8'   3C
02D9'   32 00A3!
02DC'   C3 01F6'
02DF'   CD 0335'
02E2'   7E
02E3'   57
02E4'   E6 E0
02E6'   FE 60
02E8'   28 1A
02EA'   FE 80
02EC'   28 26
02EE'   FE 20
02F0'   28 2C
02F2'   FE 40
02F4'   28 E9
02F6'   FE A0
02F8'   28 E5
02FA'   3E 15
02FC'   32 00E4!
02FF'   0E 32
0301'   C3 0000*
0304'   7A
0305'   E6 1F
0307'   32 00A0!
030A'   3E 01
030C'   32 0061!
030F'   3E 00
0311'   C3 02CA'
0314'   7A
0315'   E6 1F
0317'   32 00A0!
031A'   23
031B'   7E
031C'   18 EE
031E'   21 0000
0321'   22 00A1!
0324'   18 B9
```

```
03520           CP      80H
03530           JR      Z,RFS7          ;MULTIPLE STITCH
03540           CP      20H
03550           JR      Z,RFS8          ;BEGIN SEGMENT
03560           CP      40H
03570           JR      Z,RFS9          ;PAUSE - GET ANOTHER CMD
03580           CP      0A0H
03590           JR      Z,RFS9          ;MISC. CMD - GET ANOTHER
03600           LD      A,20            ;INVALID - SET ERR. CODE
03610           LD      (ERRCD),A
03620           LD      C,50            ;GO TO ERROR STATE
03630           JP      RSTCHG
03640   RFS6:   LD      A,D             ;GET TAUGHT SPD
03650           AND     1FH
03660           LD      (AUTSPD),A
03670           LD      A,1             ;CNT OF STCHS DECODED=1
03680           LD      (STCHCT),A
03690           JP      RFS1
03700   RFS7:   LD      A,D             ;GET TAUGHT SPD
03710           AND     1FH
03720           LD      (AUTSPD),A
03730           INC     HL              ;GET SECOND BYTE
03740           LD      A,(HL)
03750           LD      (STCHCT),A      ;CNT OF STCHS DECODED
03760           JP      RFS1
03770   RFS8:   LD      A,D             ;GET SEGMENT CNT
03780           AND     1FH
03790           LD      D,A
03800           LD      E,0
03810           LD      B,3
03820   RFS10:  SRL     D
03830           RR      E
03840           DJNZ    RFS10
03850           INC     HL              ;SECOND BYTE
03860           LD      A,(HL)
03870           OR      E
03880           LD      E,A
03890           LD      (SEGCNT),DE     ;SAVE SEG. CNT
03900           JP      RFS9            ;GET ANOTHER CMD
03910   RFS4:   LD      A,(LSSTCT)      ;ST. CNT = ORIGINAL CNT?
03920           LD      B,A
03930           LD      A,(STCHCT)
03940           CP      B
03950           JR      NC,RFS11        ;YES
03960   RFS12:  LD      HL,(SEGCNT)     ;NO - BACK UP A STITCH
03970           INC     HL
03980           LD      (SEGCNT),HL
03990           LD      HL,(SMSTCT)
04000           DEC     HL
04010           LD      (SMSTCT),HL
04020           INC     A
04030           LD      (STCHCT),A
04040           JP      RFS1            ;CHCK IF BACKED UP ENOUGH
04050   RFS11:  CALL    RDECNC          ;GET PREVIOUS TAUGHT CMD
04060           LD      A,(HL)
04070           LD      D,A             ;SAVE IT
04080           AND     0E0H
04090           CP      60H
04100           JR      Z,RFS13         ;SINGLE STITCH
04110           CP      80H
04120           JR      Z,RFS14         ;MULTIPLE STITCH
04130           CP      20H
04140           JR      Z,RFS15         ;BEGIN SEGMENT
04150           CP      40H
04160           JR      Z,RFS11         ;PAUSE - GET ANOTHER CMD
04170           CP      0A0H
04180           JR      Z,RFS11         ;MISC. CMD - GET ANOTHER
04190           LD      A,21            ;INVALID - SET ERR. CODE
04200           LD      (ERRCD),A
04210           LD      C,50            ;GO TO ERROR STATE
04220           JP      RSTCHG
04230   RFS13:  LD      A,D             ;GET TAUGHT SPD
04240           AND     1FH
04250           LD      (AUTSPD),A
04260           LD      A,1             ;SET ORG. ST. CNT = 1
04270   RFS16:  LD      (LSSTCT),A
04280           LD      A,0             ;SET CNT DECODED = 0
04290           JP      RFS12           ;BACK UP A STITCH
04300   RFS14:  LD      A,D             ;GET TAUGHT SPD
04310           AND     1FH
04320           LD      (AUTSPD),A
04330           INC     HL
04340           LD      A,(HL)
04350           JR      RFS16
04360   RFS15:  LD      HL,0            ;CLEAR SEG. CNT
04370           LD      (SEGCNT),HL
04380           JR      RFS11
04390           PAGE
04400   ;
04410   ;  ROUTINE TO INCREMENT TAUGHT CMD POINTER TO NEXT CMD
04420   ;
```

TABLE 6 cont'd

```
0326'   2A 0050!     04430   RINCNC: LD      HL,(NXTCMD)
0329'   23           04440   RINCN1: INC     HL
032A'   7E           04450           LD      A,(HL)
032B'   E6 E0        04460           AND     0E0H
032D'   FE 00        04470           CP      0
032F'   28 FB        04480           JR      Z,RINCN1
0331'   22 0050!     04490           LD      (NXTCMD),HL
0334'   C9           04500           RET
                     04510   ;
                     04520   ;  ROUTINE TO DECREMENT TAUGHT CMD PNTR TO PREVIOUS CMD
                     04530   ;
0335'   2A 0050!     04540   RDECNC: LD      HL,(NXTCMD)
0338'   2B           04550   RDECN1: DEC     HL
0339'   7E           04560           LD      A,(HL)
033A'   E6 E0        04570           AND     0E0H
033C'   FE 00        04580           CP      0
033E'   28 FB        04590           JR      Z,RDECN1
0340'   22 0050!     04600           LD      (NXTCMD),HL
0343'   C9           04610           RET
                     04620           PAGE
```

Figure 12:
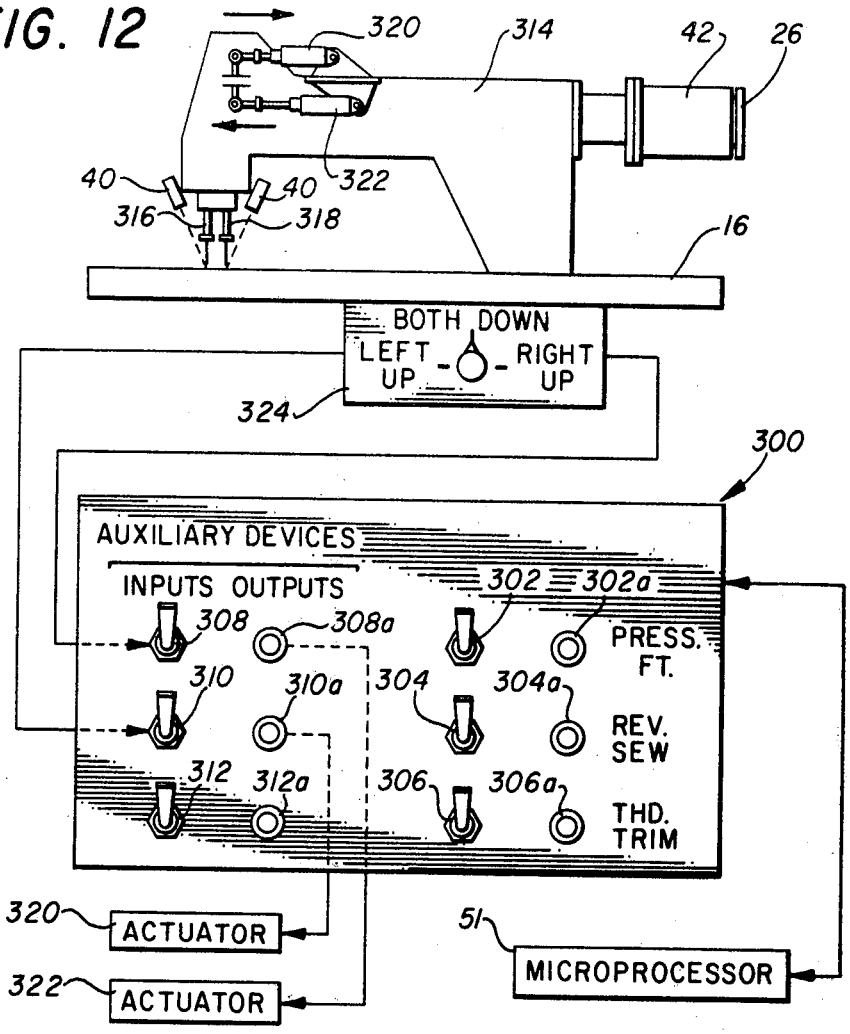
FIG. 12 is a side view of a programmable sewing system according to the invention with an interface module for controlling auxiliary devices.

With reference to FIG. 12, there is shown an optional interface module 300 which can be incorporated into semi-automatic sewing system 10 herein to control auxiliary devices as a function of stitch count. Interface module 300 is coupled between the microprocessor controller 51 and the auxiliary device to be controlled. As illustrated, the interface module 300 includes six input channels 302–312 and six corresponding output channels **302*a*–312*a*. Some of the inputs and corresponding outputs can be connected to devices usually found on a sewing machine, such as the presser foot lift actuator, reverse sew actuator and thread trimmmer actuator. The other inputs and corresponding output channels of interface module 300** can be utilized to control auxiliary devices such as stackers, trimmers, guides, zig-zag actuators, and so forth.

Under the control of microprocessor controller 51, interface module 300 receives command switch closure type input signals and generates appropriate output actuation signals. Thus, in the teach or manual modes, a device can be operated manually through the appropriate command switch. When a device is manually actuated in the teach mode, however, interface module 300 senses control inputs to the device and transmits corresponding signals which are stored in the microprocessor controller 51 as a function of stitch count. In subsequent playback of the programmed operation in the auto mode, actuation of the devices through module 300 will be controlled automatically by microprocessor controller 51.

More particularly, FIG. 12 illustrates interface module 300 in conjunction with a split needle bar, double needle sewing machine 314, which is mounted on table top 16 similar to single needle sewing machine 12 shown in FIG. 1. For purposes of clarity, the various standard controls associated with sewing machine 314 have been omitted from FIG. 12, however, it will be appreciated that many of these controls are the same as those of sewing machine 12 shown in FIG. 1. A pair of sensors 40 and associated retroreflective strip (not shown) are mounted on machine 314. Sewing machine 314 includes a left needle 316 with associated presser foot and a right needle 318 with associated presser foot. Needles 316 and 318 can be operated in unison or individually by manual actuation of conventional throwout mechanisms (not shown) connected to the needles. Suitable double-needle sewing machines, such as the Pfaff 542 or Juki LH-527, are commercially available.

A pair of actuators 320 and 322 are connected to the throw-out mechanisms of needles 316 and 318, respectively. A command switch 324 is connected between the needle throwout actuators 320 and 322 and auxiliary input channels 308 and 310 of module 300. The corresponding output channels **308*a* and 310*a* are wired to the actuators 320 and 322. In the manual and teach modes, needles 316 and 318 can be thrown out as desired by manual operation of switch 324, however, in the teach mode an appropriate control signal is generated and transmitted by module 300 for storage in the microprocessor controller 51 as a function of stitch count. In the auto mode of system 10, operation of actuators 320 and 322 is controlled automatically by microprocessor controller 51 without stopping sewing machine 314**.

Figure 13:
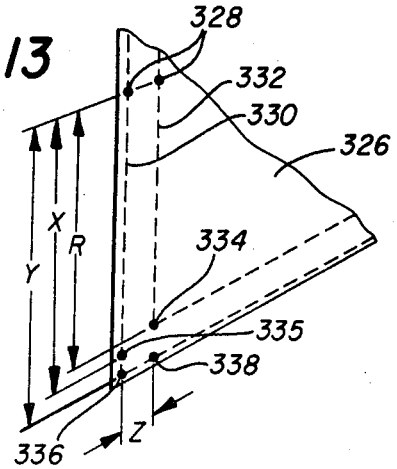
FIG. 13 is an illustration of a piece of material being provided with a double stitch pattern by means of the invention.

FIG. 13 illustrates the operation of a semi-automatic sewing system 10 with double needle sewing machine 314 sewing a double seam around a corner of a piece 326. In the teach mode, from starting points 328, both needles 316 and 318 are positioned down and operate to sew parallel seams 330 and 332 along one edge of piece 326. At point 334, the right needle 318 is raised or thrown-out after R stitches have been sewn. Sewing is continued with the left needle 316 of sewing machine 314 through point 335, where the condition of sensors 40 change at X stitches, as was discussed in reference to FIG. 5, until stopping at point 336 after Y stitches. The values R and X could be the same or different, depending upon the particular seam and shape of material being sewn. Piece 326 is then turned before Z initial stitches are sewn by the left needle 316, such as by manipulation of the one-stitch switch, before stopping at point 338 along seam 330. When left needle 316 reaches point 338, the right needle 318 is lowered again at point 334 and sewing of seam 332 is resumed as the left needle continues from point 338 sewing seam 330. The values R, X, Y and Z along with the last change in condition of sensors 40 for each seam sewn in the teach mode are stored in microprocessor controller 51.

In the auto mode of system 10, the throw-out mechanism for right needle 318 is activated at stitch count R as the left needle 316 continues stitching. As soon as the characteristic sensor 40 pattern is seen in the window (0.75X–1.05X) surrounding X, Y-X terminal stitches are sewn before stopping at end point 336 in accordance with a combination of stitch counting and edge detection as described hereinbefore. With the double needle sewing machines of the prior art, it was necessary to stop the sewing machine at each of the points 334, 336 and 338 for the operator to manually raise or lower one of the needles; however, in the auto mode of the present invention, only the right needle is stopped at point 334 as sewing machine 314 continues to point 336.

Although control of the throw-out mechanisms of a double needle sewing machine has been illustrated by way of example, it will be understood that other types of auxiliary devices can be controlled in the same manner.

FIGS. 14–18 illustrate modifications which can be incorporated into system 10 to improve its performance. These modifications are primarily in the nature of programming and/or logic changes which improve the adaptability, reliability, accuracy and capability of system 10.

In particular, those skilled in the art will appreciate the fact that a certain period of time or number of stitches is required to bring the sewing machine 12 to a precise stop from a high rate of speed. The amount of time or number of stitches required depends upon several factors including the speed of the machine and its inertia, the material type and weight, the thread type and weight, etc. Deceleration of the sewing machine 12 must be initiated at the proper time to prevent overrunning the desired seam end point, but premature deceleration can result in wasted time which is cumulative. Further, it is desirable to halt the drive unit 42 at a precise point in the rotational cycle of machine 12 to achieve the desired position (up or down) of needle 22. The microprocessor controller 51 could be programmed to initiate deceleration of machine 12 at a fixed preset number of stitches before the end of each seam; however, for seams of relatively short lengths where the sewing machine would not be operating at top speed, premature deceleration and thus wasted time would result. It is therefore desirable to maximize the time during which machine 12 operates at its highest speed and to adaptively control the point at which deceleration commences to minimize the number of slow stitches sewn at the terminal end of each seam.

Figure 14:
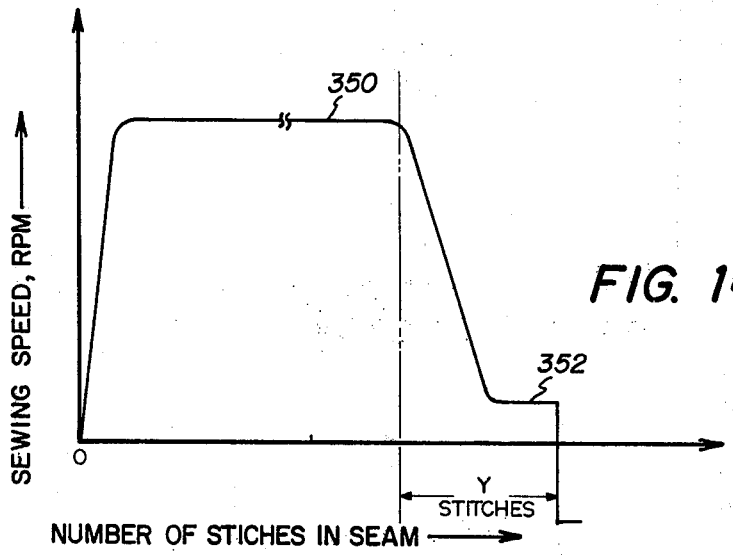
FIG. 14 is a diagram of a sewing speed profile for a seam.

FIG. 14 illustrates a typical sewing speed profile for a seam sewn in accordance with the modified logic explained below. In the teach mode, the microprocessor controller 51 of system 10 measures and stores the sewing speed profile or speed per stitch, the total number of stitches Y sewn, and the number of stitched Y-X sewn after the last status change in sensors 40 for each seam. These values are used by the microprocessor controller 51 in the auto mode to compute the adaptive number of stitches M before the end of each seam at which to initiate deceleration from the high speed of operation, such as 2000–5000 rpm, represented by line 350.

During playback in the auto mode, the microprocessor controller 51 initiates deceleration of the motor end drive unit 42 and monitors the number of stitches sewn at the "stopping" speed represented by line 352. As used herein, the stopping speed means a speed such as 300 rpm from which sewing machine 12 can be halted substantially instantaneously. One stitch or less at the stopping speed represented by line 352 is considered acceptable, however, if the microprocessor controller 51 measures that more than one stitch was sewn at the stopping speed, the stored value M is decremented by the excess number of slow stitches sewn. If, on the other hand, the microprocessor controller 51 measures that too many stitches were sewn and that the seam end was overrun, the stored value M is increased. The stored value M for each seam is thus adaptively adjusted during each sewing operation to maintain the number of stitches sewn at the slow speed to one stitch or less.

In the first embodiment of the invention, a window of 0.75X to 1.05X, for example, was set up around the number of stitches X sewn at the time of the last status change or "toggle" in the sensors 40 in order to eliminate spurious signals. This logic works well with pieces of slightly different sizes, but has been found to be a limiting factor when sewing pieces of substantially smaller or larger sizes wherein the requisite sensor state may not appear in such a window. Also, the logic of storing only the last sensor condition for comparison in determing the end point of each seam may not be acccurate for all sewing operations. It is thus desirable to completely eliminate the window wherein the characteristic sensor pattern is expected so that a wide range of part sizes as well as inaccurately cut parts can be sewn using the same taught program, and to revise the sensor logic so that it does not rely simply on the last sensor pattern to initiate seam termination and can therefore accommodate a wider variety of sewing operations.

Figure 16:
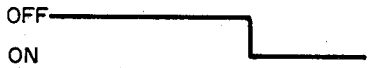
FIGS. 16 and 17 are waveform diagrams illustrating the sensor status while sewing the seams of the patch pocket in FIG. 15.
Figure 17:
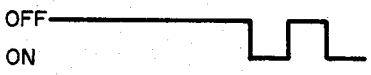
Figure 15:
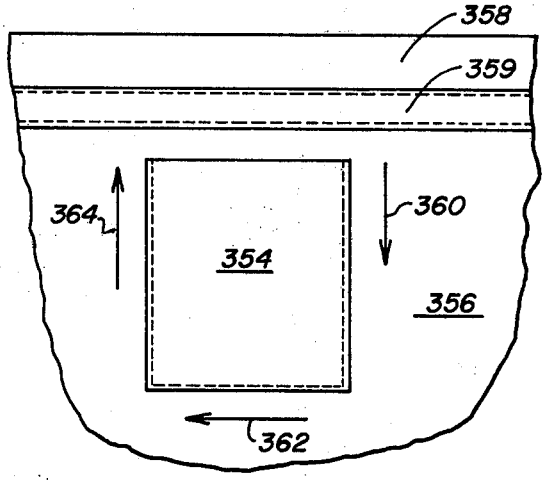
FIG. 15 is an illustration of a patch pocket sewn to a pants panel.

FIG. 15 shows a sewing operation which illustrates the advantages of the revised sensor logic described more fully hereinafter. When a patch pocket 354 is set on a pants panel 356, a riser or yoke 358 is sometimes provided above the pocket usually for purposes of style. When sewing the right-hand and bottom seams in the directions respectively indicated by arrows 360 and 362, the sensor state contains one change or toggle as represented by FIG. 16. However, when sewing the left-hand seam in the direction of arrow 364, the sensor 40 toggles more than once as represented by FIG. 17 as it senses the boundary of pocket 354 and then yoke seam 359. Although the last sensor status is correct, it references the yoke seam 359 instead of pocket 354. Thus, reliance can be placed on the last sensor state for terminating the right-hand and bottom seams, but not for terminating the left-hand seam.

In accordance with the revised logic of this modification, the status changes or toggles of sensors 40 for each seam are stored by the microprocessor controller 51 in the teach mode. During playback in the auto mode, the microprocessor controller 51 is programmed to compare the sensor toggles with the stored toggle history for that seam as each seam is being sewn so that, once the proper toggle sequence has been achieved, countdown of Y-X terminal stitches can be initiated to complete the seam. The toggle sequences programmed into system 10 in the teach mode are thus utilized to control seam lengths and end points in the auto mode.

As explained above in connection with FIG. 14, the revised logic provides for adaptive adjustment of the number of stitches before the end of each seam at which deceleration of sewing machine 12 is initiated to prevent overrunning the seam end points. If the last toggle condition of sensors 40 occurs such that the stored value M is less than the value of Y-X stitches stored in microprocessor controller 51, the logic also provides for decrement back to the previous sensor toggle point as the basis for terminating the seam in the auto mode. For example, in the case of the left-hand seam on the patch pocket 354 shown in FIG. 15, the last off/on toggle on the far side of yoke seam 359 would be checked and determined to afford insufficient time to decelerate sewing machine 12. The microprocessor controller 51 would then automatically go back to the on/off sensor toggle at the front edge of yoke seam 359 and check again if a sufficient number of stitches remained to decelerate sewing machine 12 to a precise stop, and, if not, the controller would then back up once again to the off/on toggle occurring at the pocket boundary as the basis for terminating the seam.

If there is only one sensor toggle along a seam, such as the right-hand and bottom seams of the patch pocket 354 in FIG. 15, and an insufficient number of stitches remain in the seam to properly decelerate sewing machine 12, the seam will be sewn in the auto mode as programmed but an error code will appear on the main control panel 44 indicating that the dynamic capabilities of system 10 had been exceeded.

A further revision to the sensor logic comprises checking the sensor condition at the start of each seam in the auto mode against the stored sensor condition programmed in the teach mode. If the sensed and stored initial sensor conditions are not the same, the system 10 reverts to pure stitch counting to determine the seam length and end point. This feature is particularly useful for very short seams where the condition of sensors 40 may not consistently be the same due to irregularities in the material, etc.

As stated above, the revised sensor logic eliminates the use of a window around the adaptive value of X stitches for each seam. The purpose of this window was to avoid picking up spurious signals from false sensor toggles which could prematurely initiate termination of a seam. To provide noise protection for sensors 40, the sensor logic can also be revised to include the requirement that sensor toggles must last for more than one stitch before the microprocessor controller 51 will respond to such toggles. Momentary sensor toggles which endure for less than one stitch are thus filtered out as spurious signals.

Another important feature represented by the modified control logic for system 10 comprises enhancement of the seam length accuracy from ±1 stitch to ±0.5 stitch. It will be appreciated that a status change or toggle of sensors 40 can occur anytime during the one revolution of the motor within drive unit 42 required to form a stitch. A ±1 stitch accuracy is obtained when sensors 40 change state immediately before or immediately after the needle position where the microprocessor controller 51 recognizes such changes. It will further be appreciated that many sewing machine feed mechanisms only advance material over a portion of the stitch forming cycle. For example, in a needle feed machine, advancement of the material occurs when the needle is in the material. Material advancement is continuous and uniform throughout the complete stitch forming cycle in a continuous feed machine. It is thus desirable to be able to read sensors 40 more than once during each stitch cycle and to compensate for the particular material feed characteristics for the sewing machine 12.

Figure 18:
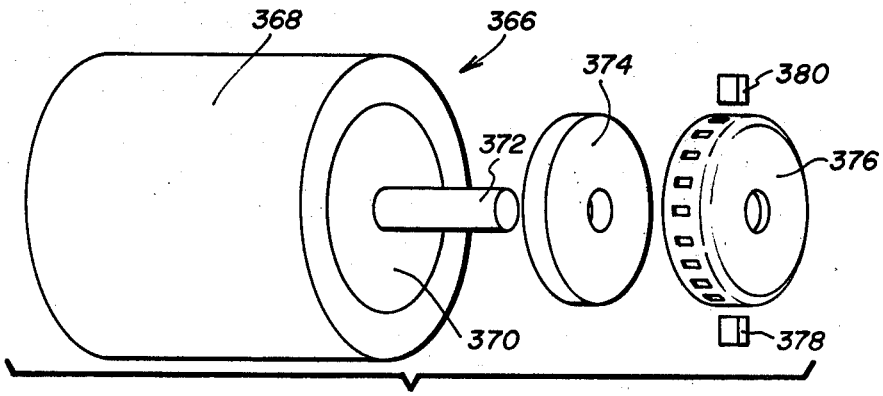
FIG. 18 is a perspective view of the modified drive unit.

FIG. 18 shows an exploded perspective illustration of the modified drive unit 366 which can be utilized in system 10. Drive unit 366 includes a housing 368 enclosing a variable speed drive motor 370 having a drive shaft 372 coupled directly to the drive shaft of sewing machine 12. An electromagnetic brake 374 is secured to shaft 372 as are a sensor vane 376 and the hand wheel 26, which has been omitted from FIG. 18 for clarity. The sensor vane 376 includes a plurality of uniformly spaced openings therearound which cooperate with sensors 378 and 380 to provide a more precise measurement to the microprocessor controller 51 of the angle in the sewing cycle at which each status change in sensors 40 occurs. As illustrated, sensor vane 376 includes 36 evenly spaced circumferential openings therein to achieve a resolution of 10°. Sensor 378 provides a reference or sync signal against which the motor angle signals from sensor 380 are compared within microprocessor controller 51 to fix the angular position in the sewing machine cycle, and thus the needle position, where each toggle of edge sensors 40 occurs.

Any suitable interrupt type sensors can be used for sensors 378 and 380. For example, a Model TIL 147 photoptical sensor from Texas Instruments Corporation can be used for sensor 380. A Model TL 172C hall effect sensor from Texas Instruments Corporation can be used for sensor 378.

Since a change of state or toggle of sensor 40 is transmitted to the microprocessor controller 51 via an interrupt channel thus providing an immediate indication of the sensor change relative to the stitch forming cycle, the microprocessor controller can be programmed with an algorithm for deciding whether a stitch should be added or deleted at the end of the seam. The algorithm for determining the number of stitches to be sewn after the relevant sensor toggle is as follows:

Y=number of stitches to be sewn after sensor changes state or toggles;

Sew Y stitches if $|\phi \text{ auto} - \phi \text{ teach}|$ is less than $\Delta$.

Sew Y+1 stitches if ($\phi$ auto$-\phi$ teach) is greater than $\Delta$.

Sew Y−1 stitches if ($\phi$ auto$-\phi$ teach) is less than $\Delta$.

Where: $\phi$ stop=angle at which material feed stops during the sewing cycle;

$\phi$ start=angle at which material feed starts;

$\Delta=(\phi \text{ stop}-\phi \text{ start})/2$;

$\phi$ teach=angle at which sensor toggles in the teach mode;

$\phi$ auto=angle at which sensor toggles in the auto mode.

In order to use the foregoing algorithm correctly, system 10 must be provided with the particular material feed characteristics of sewing machine 12. One way to provide this information to microprocessor controller 51 is to input the angles $\phi$ start and $\phi$ stop via the keyboard 167 on auxiliary control panel 52. Another way to do this would be to provide a calibration software routine for the microprocessor controller 51 which would enable it to self calibrate and automatically determine the $\phi$ start and $\phi$ stop values for a given machine and stitch length setting.

Figure 19:
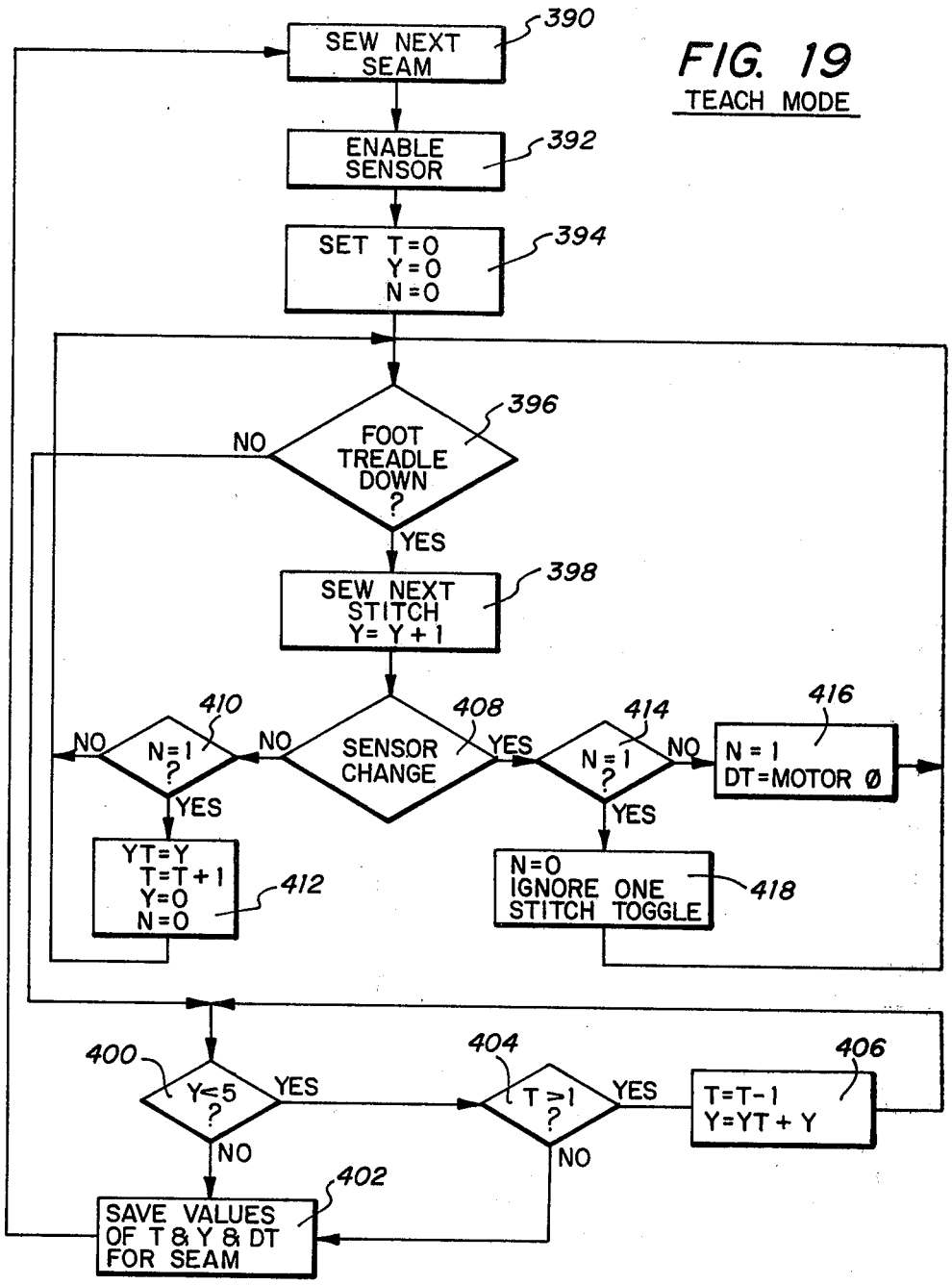
FIG. 19 is a diagram of the modified control logic of the system in the teach mode.
Figure 20A:
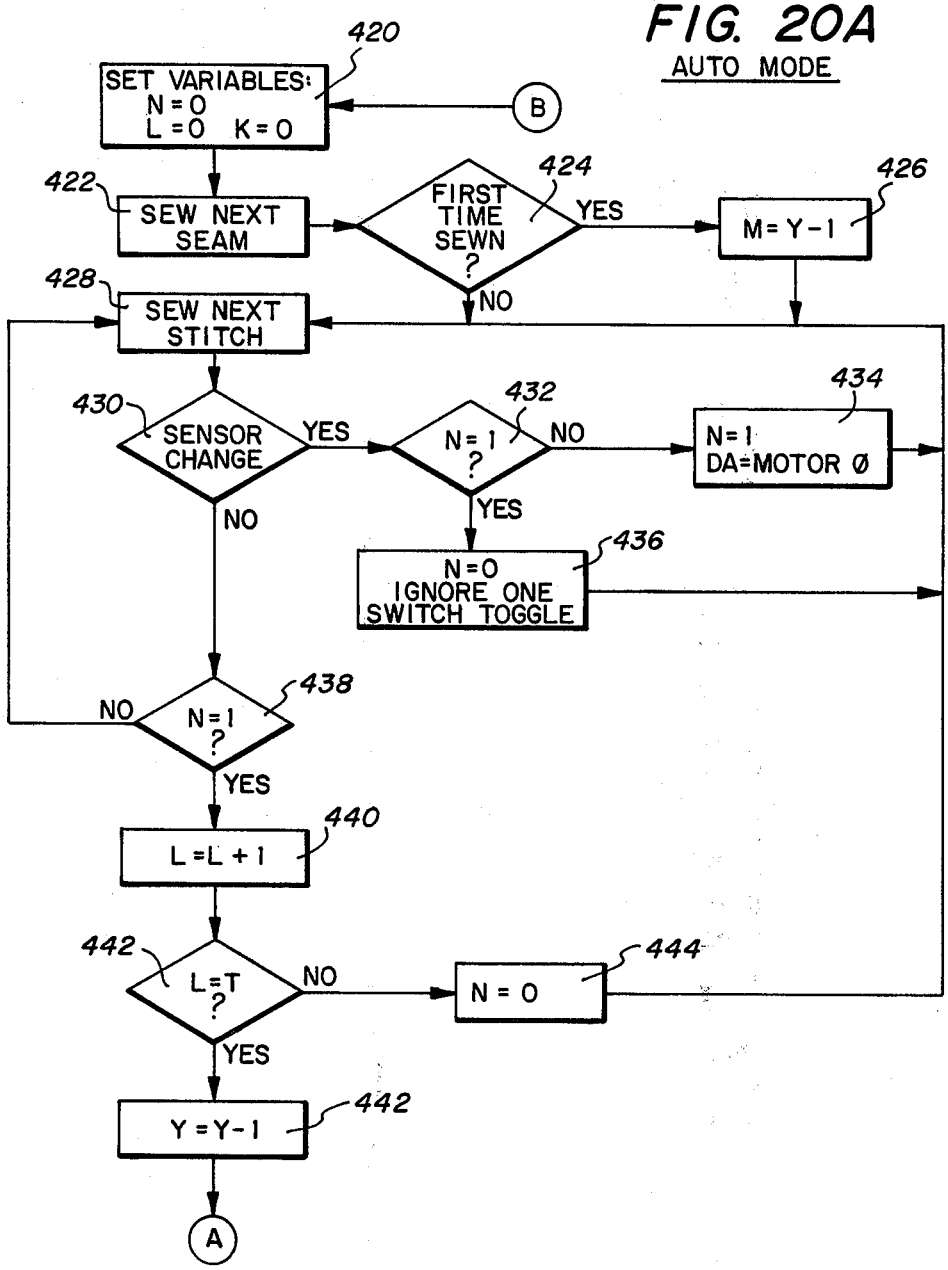
FIGS. 20*a* and 20*b* are diagrams of the modified control logic of the system in the auto mode.
Figure 20B:
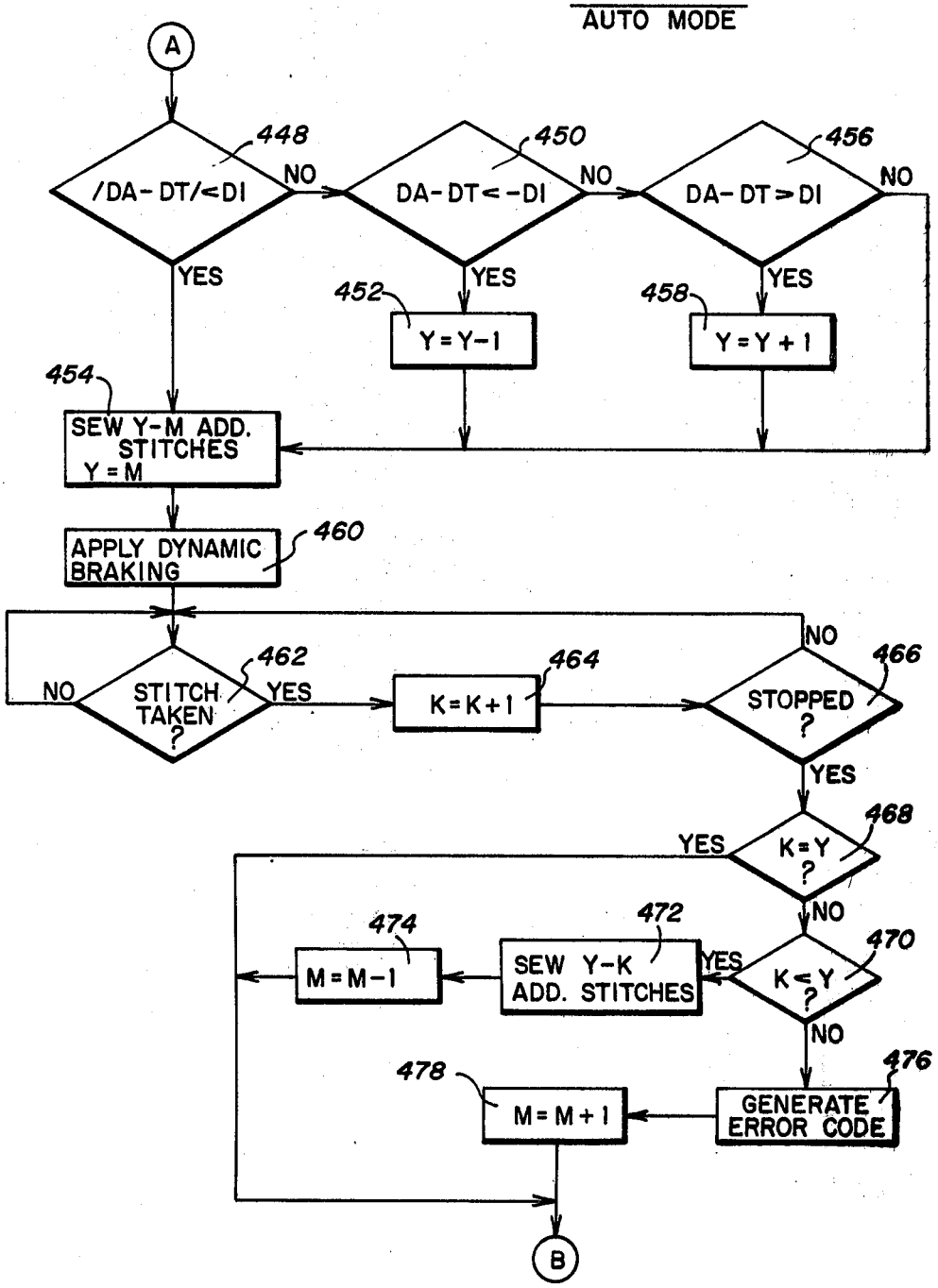

Referring now to FIGS. 19 and 20*a* and *b*, there are shown the flow charts for the control logic utilized by sensors 40 in the modified teach and auto modes of system 10. The meanings of the variables are as follows:

T=no. of taught sensor toggles in the teach mode.

Y=no. of sensed stitches sewn in the teach mode after the last sensor toggle.

DT=taught angle of motor 370 at which final sensor toggle occurred in the teach mode.

DA=sensed angle of motor 370 at which final sensor toggle occurred in the auto mode.

DS=angle of motor 370 at which stitch formation begins.

DE=angle of motor 370 at which stitch formation terminates.

D1=(DE−DS)/2.

M=seam stopping variable.

Referring to FIG. 19 in particular, the teach mode control logic for each seam begins at 390 with the command to sew the next seam after which sensors 40 are enabled at 392. The values T, Y and N are then set to zero at 394.

An inquiry is then made at 396 whether foot treadle 28 is down. If so, the logic proceeds to 398 where a stitch is sewn and Y is incremented. If foot treadle 28 is not down, an inquiry is made at 400 whether Y is less than 5. If Y is greater than or equal to 5, the values T, Y and DT are stored at 402 before returning to 390. If Y is less than 5, an inquiry is made at 404 whether T is greater than 1, and, if not, the logic proceeds to 402. If T is greater than 1, T is declemented and Y is set to YT+Y at 406 before returning to 400.

If foot treadle 28 is down, another stitch is sewn and Y is incremented at 398 before an inquiry is made at 408 whether there has been a change of state or toggle of sensors 40 since the last logic loop. If there has been no sensor change, an inquiry is made at 410 whether N=1, and, if not, another inquiry is made at 396. If N does equal one, YT is set to Y, T is incremented, and Y and N are set to zero at 412 before proceeding to 396 where the up or down position of foot treadle 28 is checked.

If there has been a sensor change at 408, and inquiry is made at 414 whether N=1. If N is not equal to 1, N is set to 1 at 416 and DT is set to the motor angle before returning to 396. If N does equal 1, N is set to zero at 418 and a command is given to ignore the one stitch sensor toggle before returning to 396.

Referring particularly to FIGS. 20*a* and *b*, the control logic in the auto mode begins at 420 by setting the variables N, L and K to zero. At 422 a command is given to sew the next seam after which an inquiry is made at 424 whether it is the first time that seam is being sewn. If so, M is set to Y−1 at 426 before proceeding to 428. Thus, the seam stopping variable M is initially set to one stitch less than the taught number of stitches between transition of sensors 40 and the seam end point for the first time that seam is sewn in the auto mode. If it is not the first time that seam is being sewn, the logic proceeds directly from 424 to 428.

After the next stitch has been sewn at 428, an inquiry is made at 430 whether there has been a change of state or toggle in sensors 40 since the last stitch. If so, an inquiry is made at 432 whether N equals one. If not, then at 434 N is set to one and DA is set to the motor angle before returning to 428. If N does equal one, then N is set to zero and the one stitch toggle is ignored at 436 before returning to 428. A sensor change on each of two consecutive stitches thus indicates a momentary or false toggle of sensors 40.

If there has been no sensor change, an inquiry is made at 438 whether N equals one. If not, then another stitch is sewn at 428. If N does equal one, L is incremented at 440. L corresponds to the number of sensor toggles sensed in the auto mode. Then an inquiry is made at 442 whether L equals T. If not, N is again set to zero at 444 before sewing another stitch at 428. If L equals T, which means that the taught and sensed toggle histories for that seam correspond, Y is decremented at 446 to subtract the stitch count registered after sensors 40 changed state.

After 446, an inquiry is made at 448 whether the absolute value of DA minus DT is less than DI. If not, another inquiry is made at 450 whether the difference between DA and DT is less than minus DI. If the answer to the inquiry of 450 is yes, Y is decremented at 452 before proceeding to 454. If the answer to the inquiry of 450 is no, another inquiry is made at 456 whether the difference between DA and DT is greater than DI. After 456, the logic proceeds to 454, however, Y is first incremented at 458 if the answer to the inquiry is yes. Decisions 448, 450 and 456 thus comprise the algorithm by which the microprocessor controller 51 determines how many terminal stitches to take after transistion of sensors 40.

If the absolute value of the difference between DA and DT is less than DI, then Y−M additional stitches are sewn and Y is set to M at 454 before dynamic breaking is applied at 460. An inquiry is then made at 462 whether a stitch has been taken, and, if not, another such inquiry is made. If a stitch has been taken, K is incremented at 464 to keep track of the number of stitches sewn after braking started before an inquiry is made at 466 whether sewing machine 12 has stopped. If the sewing machine has not stopped, the logic returns to the inquiry of 462. If the sewing machine has stopped, an inquiry is made at 468 whether K matches Y. If K equals Y, the logic returns to 420. If K does not equal Y, an inquiry is made at 470 whether K is less than Y. If K is less than Y, indicating that braking started too soon, Y−K additional stitches are sewn at 472 and M is decremented at 474 before returning to 420. Thus, the seam stopping variable M is monitored and adaptively adjusted, if necessary, each time the seam is sewn in the auto mode. If K is not less than Y, indicating that the dynamic capabilities of system 10 have been exceeded, an error code is generated at 476 and M is incremented at 478 so that braking is initiated sooner before returning to 420.

A program listing, with comments, for the microprocessor controller 51 of system 10 in the modified teach and auto modes discussed above is set forth in Table 7 below. The program is particularly adapted for a Zilog Z-80 microprocessor, and is written in Z-80 assembly language in accordance with the Z-80 CPU manual available from Zilog Corporation.

In view of the foregoing, it will be apparent that the present invention comprises an adaptive sewing machine control system having significant advantages over the prior art. The system herein utilizes a combination of stitch counting and edge detection to achieve precise seam lengths and end points. A sensor is located ahead of the sewing needle for detecting the approach of the material boundary following each seam. Most of the operations of the sewing machine are controlled by the microprocessor as a function of stitch count, however, the only stitch counting that is utilized to determine seam length comprises a relatively small variable number of stitches at the end of each seam. Countdown of the variable terminal number of stitches can be initiated by correspondence of the taught and sensed final toggle conditions or correspondence of the taught and sensed toggle histores. Spurious signals which could cause premature initiation of the final stitch countdown are avoided either by setting up a window around the stitch count corresponding to the last change in sensor condition before the end of the seam, or by ignoring momentary toggles of the edge sensors. Other advantages will be apparent to those skilled in the art.

Although particular embodiments of the invention have been illustrated in the accompanying Drawing and described in the foregoing Detailed Description, it shall be understood that the invention is not limited only to the embodiments disclosed, but embraces any alternatives, equivalents, modifications and/or rearrangements of elements as fall within the scope of the invention as defined by the following claims.

TABLE 7

```
01480 RBGSM:  LD      HL,AUTOFL        ;OP. ASST. EXIT SET ?
01490         BIT     7,(HL)
01500         JR      NZ,RBGSM1        ;YES
01510         RES     2,(HL)           ;NO - RST P.T. FLAG
01520         RES     3,(HL)           ;RST S.T. FLAG
01530 RBGSM1  INC     HL
01540         INC     HL               ;RESET CNTR INHIBIT FLG
01550         RES     1,(HL)
01560         SET     2,(HL)           ;SET READ SENSOR FLAG
01570         LD      A,D              ;GET FABRIC SENSOR CODE
01580         AND     06H
01590         SRL     A
01600         LD      (FBSNCD),A       ;SAVE CODE
01610         LD      HL,0
01620         LD      (SEGCNT),HL      ;ZERO SEG. STITCH CNT
01630         LD      (SMSTCT),HL      ;ZERO SEAM STITCH CNT
01640         LD      HL,(NXTCMD)      ;GET # OF TOGGLES
01650         INC     HL
01660         LD      A,(HL)
01670         LD      (TOGGLE),A       ;SAVE
01680         CP      0                ;TOGGLE = 0 ?
01690         JR      Z,RBGSM5         ;YES, STITCH COUNT ONLY
01700 RBGSM2  INC     HL               ;FIND TOTAL # OF STITCHES
01710         LD      A,(HL)           ;   IN SEAM
01720         AND     0E0H
01730         CP      0C0H             ;BEGIN SEAM ?
01740         JR      Z,RBGSM3         ;YES, EXIT LOOP
01750         CP      0E0H             ;END PIECE ?
01760         JR      Z,RBGSM3         ;YES, EXIT LOOP
01770         CP      20H              ;BEGIN SEGMENT ?
01780         JR      NZ,RBGSM2        ;NO - LOOP SOME MORE
01790         LD      A,(HL)           ;YES, SAVE STITCH COUNT
01800         AND     1FH
01810         CALL    RBSM10           ;CALCULATE STITCH COUNT
01820         PUSH    HL
01830         LD      HL,(SEGCNT)
01840         ADD     HL,DE            ;TOTAL # OF STITCHES
01850         LD      (SEGCNT),HL
01860         POP     HL
01870         JR      RBGSM2
01880 RBGSM3  CALL    RBGSM9
01890         INC     HL
01900         LD      (SAVNXT),HL
01910 RBGSM4  CALL    RBGSM9
01920         LD      (FBSNCT),DE
01930         LD      HL,(SEGCNT)      ;IS SEGCNT - FBSNCT
01940         OR      A                ;   > OR = FIVE
01950         SBC     HL,DE
01960         LD      DE,4
01970         OR      A
01980         SBC     HL,DE
01990         JR      NC,RBGSM8        ;YES, ENABLE SENSOR
02000         LD      A,(TOGGLE)       ;NO - DEC. TOGGLE AND SEE
02010         DEC     A                ;   IF IT IS ZERO
02020         CP      0
02030         JR      Z,RBSM12         ;ZERO, USE TOGGLE ANYWAY
02040         LD      (TOGGLE),A
02050         JR      RBGSM4
```

TABLE 7 cont'd

```
02060 RBGSM5:  INC    HL
02070          LD     (SAVNXT),HL
02080 RBGSM6:  LD     HL,AUTOFL          ;RESET WINDOW ENABLE FLAG
02090          RES    6,(HL)
02100 RBGSM7:  LD     HL,(SAVNXT)
02110          LD     (NXTCMD),HL
02120          JP     RBKGRD
02130 RBSM12:  LD     DE,(FBSNCT)
02140          LD     HL,(SEGCNT)        ;SEGCNT = FBSNCT ?
02150          OR     A                  ;   (NO STITCHES TO STOP)
02160          SBC    HL,DE
02170          JR     Z,RBGSM6           ;YES, STITCH COUNT ONLY
02180          LD     HL,(SEGCNT)        ;SEGCNT = FBSNCT + 1 ?
02190          SCF                       ;   (ONE STITCH TO STOP)
02200          SBC    HL,DE
02210          JR     Z,RBGSM6           ;YES, STITCH COUNT ONLY
02220 RBGSM8:  LD     HL,AUTOFL          ;SET WINDOW ENABLE FLAG
02230          SET    6,(HL)
02240          JR     RBGSM7
02250 ;
02260 RBGSM9:  LD     A,(TOGGLE)         ;FIND STITCH COUNT FOR
02270          LD     D,0                ;   THIS # OF TOGGLES -
02280          SLA    A                  ;  FROM THE BEGIN SEAM CMD
02290          LD     E,A
02300          LD     HL,(NXTCMD)
02310          ADD    HL,DE              ;POINT TO TOGGLE STITCH
02320          LD     A,(HL)             ;   COUNT
02330 RBSM10:  LD     D,A                ;CALCULATE STITCH COUNT
02340          LD     E,0                ;   AT TOGGLE
02350          LD     B,8
02360 RBSM11:  SRL    D
02370          RR     E
02380          DJNZ   RBSM11
02390          INC    HL
02400          LD     A,(HL)
02410          OR     E
02420          LD     E,A
02430          RET
02440          PAGE
02450 RBGSEG:  LD     A,D                ;GET SEG. CNT
02460          AND    1FH
02470          LD     D,A
02480          LD     E,0
02490          LD     B,3
02500 RBGSG1:  SRL    D
02510          RR     E
02520          DJNZ   RBGSG1
02530          LD     A,(HL)
02540          OR     E
02550          LD     E,A
02560          LD     (SEGCNT),DE
02570          INC    HL                 ;GET DECEL FACTORS
02580          LD     (BSPNTR),HL
02590          PUSH   HL
02600          LD     HL,AUTOFL+2        ;IS CLEAR DECEL FLAG SET
02610          BIT    4,(HL)
02620          POP    HL
02630          JR     Z,RBGSG3           ;NO
```

TABLE 7 cont'd.

```
02640          LD      (HL),0          ;YES, CLEAR FACTORS
02650          INC     HL
02660          LD      (HL),05H
02670          DEC     HL
02680 RBGSG3   LD      A,(HL)
02690          AND     0FH
02700          CP      6
02710          JR      C,RBGSG2
02720          OR      0F0H
02730 RBGSG2   LD      (DECEL),A
02740          INC     HL
02750          LD      A,(HL)
02760          CP      6
02770          JR      C,RBGSG4
02780          OR      0F0H
02790 RBGSG4   LD      (OVERRN),A
02800          INC     HL              ;SAVE NEXT CMD ADDR
02810          LD      (NXTCMD),HL
02820          LD      HL,AUTOFL       ;RST OP. STOP FLAG
02830          RES     5,(HL)
02840          CALL    RCALSP          ;CALC. SEWING PARAMETERS
02850          LD      HL,AUTOFL
02860          SET     1,(HL)          ;SET FIRST STITCH FLAG
02870          JP      RBKGRD
01480 ; AUTO - ACCELERATING
01490 ;
01500 RST026:  CALL    RCHKNI          ;NEEDLE INTR. ?
01510          JP      Z,RS026A        ;NO
01520          CALL    RASNRD          ;CHECK INITIAL SEN. COND.
01530          CALL    RGETST          ;GET NEXT STITCH
01540          CALL    RWHOA           ;DYN. BRK. IF NEEDED
01550          LD      DE,(HLFCNT)     ;SEG. CNT G.T.E. HALF ?
01560          OR      A
01570          SBC     HL,DE
01580          JR      NC,RS026B       ;YES
01590          LD      A,(SD)          ;NO, START DECEL
01600          LD      HL,ACCLRT
01610          SUB     (HL)
01620          CALL    RMLCLP          ;CLIP AT 4
01630          LD      (SD),A
01640          LD      C,30            ;GO TO AUTO - DECELERATE
01650          JP      RSTCHG
01660 RS026B   LD      A,(SD)          ;GET SPEED
01670          LD      HL,ACCLRT       ;ADD ACCEL. INCR.
01680          ADD     A,(HL)
01690          LD      C,A             ;SAVE CURRENT SPD + INCR
01700          LD      HL,AUTOFL+1     ;AUTO-RAMP ENABLE ?
01710          BIT     4,(HL)
01720          JR      NZ,RS026C       ;YES
01730          LD      A,(AUTSPD)      ;NO - GET TAUGHT SPD
01740          LD      (SD),A
01750          CALL    RLSPIN          ;SPD = TAUGHT X L S I
01760          CP      C               ;ACCEL. SPD > TGT. SPD ?
01770          JR      NC,RS026D       ;NO - KEEP ACCEL.
01780          LD      C,28            ;GO TO SEWING TAUGHT
01790          JP      RSTCHG
01800 RS026D:  LD      A,C             ;SPD = OLD SPD + INCR
01810          LD      (SD),A
01820          JR      RS026E
```

TABLE 7 cont'd.

```
01830 RS026D:  LD      A,(MAXSPD)        ;GET MAX. SPD IN SEG
01840          CP      C                 ;ACCEL. SPD > MAX. SPD?
01850          JR      NC,RS026D         ;NO - CONTINUE ACCEL
01860          LD      (SD),A            ;SET SPD = MAX. SPD
01870          LD      C,27              ;GO TO AUTO - HOLD MAX SP
01880          JP      RSTCHG
01890 RS026A:  CALL    RCHKOS            ;CHECK FOR OPER. STOP
01900 RS026E:  JP      RCLR              ;NO STOP - RST UNUSED FLG
01910          PAGE
01930 ;  AUTO - HOLDING MAX. SPEED IN AUTO-RAMP MODE
01940 ;
01950 RST027:  CALL    RCHKNI            ;NEEDLE INTR. ?
01960          JR      Z,RS027A          ;NO
01970          CALL    RGETST            ;YES - GET NEXT STITCH
01980          CALL    RWHOA             ;DYN. BRK. IF NEEDED
01990          LD      DE,(MXSPCT)       ;TIME TO BEGIN DECEL ?
02000          SCF
02010          SBC     HL,DE
02020          JR      NC,RS027B         ;NO
02030 RS027C:  LD      A,(SD)            ;YES
02040          LD      HL,ACCLRT
02050          SUB     (HL)
02060          CP      4                 ;CLIP AT 4
02070          JP      P,RS027D
02080          LD      A,4
02090 RS027D:  LD      (SD),A
02100          LD      C,30              ;GO TO AUTO - DECEL
02110          JP      RSTCHG
02120 RS027A:  CALL    RCHKOS            ;CHECK FOR OPER. STOP
02130 RS027B:  JP      RCLR              ;NO STOP - RST UNUSED FLG
02140          PAGE
02750 ;  AUTO - DECELERATING
02760 ;
02770 RST030:  CALL    RCHKNI            ;NEEDLE INTR. ?
02780          JP      Z,RS030A          ;NO
02790          CALL    RGETST            ;YES - GET NEXT STCH
02800          CALL    RWHOA             ;DYN. BRK. IF NEEDED
02810          LD      DE,1              ;LAST ST. IN SEG ?
02820          SCF
02830          SBC     HL,DE
02840          JR      NC,RS030B         ;NO
02850 RS030E:  LD      HL,CTLFL          ;YES - CMD PLAT. SPD
02860          RES     1,(HL)
02870          LD      A,0
02880          LD      (SD),A
02890          LD      C,32              ;GO WAIT FOR STOP
02900          JP      RSTCHG
02910 RS030B:  LD      A,(SD)            ;SPEED = 3 ?
02920          LD      HL,ACCLRT
02930          SUB     (HL)
02940          CP      4
02950          JP      M,RS030C          ;YES
02960          LD      (SD),A
02970          JR      RS030A
02980 RS030C:  LD      HL,AUTOFL         ;OPER. STOP ?
02990          BIT     5,(HL)
03000          JR      NZ,RS030E         ;YES
03010          LD      HL,CTLFL          ;NO - SEW PLAT. TO END
03020          SET     1,(HL)
03030          LD      A,0
```

TABLE 7 cont'd.

```
03040          LD      (SD),A
03050          LD      C,31
03060          JP      RSTCHG
03070 RS030A   JP      RCLR              ;RST UNUSED FLAGS
03080          PAGE
03090 ;
03100 ;  AUTO - SEWING AT PLATEAU SPEED
03110 ;
03120 RST031:: CALL    RCHKNI            ;NEEDLE INTR  ?
03130          JR      Z,RS031A          ;NO
03140          CALL    RGETST            ;YES, GET NEXT STITCH
03150          CALL    RBRAKU            ;CHECK DECEL FACTOR
03160          LD      DE,1              ;LAST STCH. IN SEG  ?
03170          SCF
03180          SBC     HL,DE
03190          JR      C,RS031B          ;YES
03200          LD      A,(K)             ;NO: MORE THAN K+2 STCHS?
03210          LD      E,A
03220          OR      A
03230          SBC     HL,DE
03240          JR      C,RS031A          ;NO - CONTINUE PLAT  SEW
03250          LD      A,(SPSTA)         ;STILL DYN  BRAKING ?
03260          CP      2
03270          JR      Z,RS031A          ;YES
03280          LD      A,(CMNDS)         ;NO - TURN OFF PLATEAU
03290          AND     07H
03300          CALL    ROUTCD
03310          LD      A,1
03320          LD      (SPSTA),A
03330          LD      A,(AUTSPD)        ;SET SPD = TAUGHT
03340          LD      (SD),A
03350          CALL    RLSPIN            ;APPLY LRN SPD INCREASE
03360          LD      C,28              ;GO SEW TAUGHT PROFILE
03370          JP      RSTCHG
03380 RS031D   LD      HL,AUTOFL         ;SET OPER  STOP FLAG
03390          SET     5,(HL)
03400 RS031B   LD      HL,CTLFL          ;RST STOP OVRD
03410          RES     1,(HL)
03420          LD      C,32              ;GO WAIT FOR STOP
03430          JP      RSTCHG
03440 RS031A   CALL    RRDFTR            ;OPERATOR STOP ?
03450          CP      3
03460          JR      C,RS031D          ;YES
03470          JP      RCLR              ;NO, RST UNUSED FLAGS
03480          PAGE
03490 ;
03500 ;  AUTO - WAIT FOR STOPPED FLAG TO BE SET
03510 ;
03520 RST032:: CALL    RCHKNI            ;NEEDLE INTR  ?
03530          JR      Z,RS032A          ;NO
03540          CALL    RASNRD            ;CHECK INITIAL SEN. COND.
03550          CALL    RGETST            ;GET NEXT STITCH
03560 RS032A   LD      HL,CTLFL          ;STOPPED FLAG SET ?
03570          BIT     0,(HL)
03580          JR      Z,RS032D          ;NO
03590          LD      HL,AUTOFL         ;YES - IS OP  STOP SET ?
03600          BIT     5,(HL)
03610          JR      NZ,RS032B         ;YES
03620          CALL    RBRAKE            ;NO, SET DECEL FACTORS
```

TABLE 7 cont'd.

```
03630          LD      C,22              ;SEG  IS FINISHED
03640          JP      RSTCHG
03650 RS032B:  LD      HL,AUTOFL+1       ;IS OF  ASST  ON ?
03660          BIT     0,(HL)
03670          JR      NZ,RS032C         ;YES
03680          LD      C,33              ;NO - GO TO STOPPED BY OF
03690          JP      RSTCHG
03700 RS032C:  LD      C,34              ;GO TO WAIT FOR OF  ASST
03710          JP      RSTCHG
03720 RS032D:  CALL    RCLFCT            ;CLEAR FCTFLAG
03730          JP      RCLR              ;RST UNUSED FLAGS
03740          PAGE
00280 ;
00290 ;  ROUTINE TO CHECK DECEL FACTOR WHEN SLOW STITCHES ARE
00300 ;     ENCOUNTERED IN AUTO MODE.  (CALLED FROM RST031)
00310 ;
00320 RBRAKU:  LD      A,(SPSTA)         ;ARE WE STILL IN DYN BRAK
00330          CP      2
00340          RET     Z                 ;YES, NO SLOW STITCHES
00350          LD      A,(BRAKE)         ;IS BRAKE LARGER THAN
00360          CP      L                 ;   # OF STITCHES LEFT ?
00370          RET     NC                ;YES
00380          LD      A,L               ;NO, SAVE NEW BRAKE
00390          LD      (BRAKE),A
00400          RET
00410          PAGE
00420 ;
00430 ;  ROUTINE TO CHECK DECEL FACTOR WHEN THERE ARE OVER RUN
00440 ;    STITCHES IN AUTO MODE.  (CALLED FROM RGETST)
00450 ;
00460 RBRAKO:  PUSH    HL
00470          LD      A,27              ;OVER RUN ERROR
00480          LD      (ERRCD),A
00490          CALL    RERDIS            ;DISPLAY ERROR CODE
00500          LD      HL,AUTOFL+2       ;SET OVER RUN FLAG
00510          SET     3,(HL)
00520          POP     HL
00530          LD      A,(BRAKE+1)       ;BRAKE + 1 SMALLER THAN
00540          CP      L                 ;   NUMBER OF STITCHES
00550          RET     M                 ;NO
00560          LD      A,L               ;YES - SAVE NEW BRAKE + 1
00570          LD      (BRAKE+1),A
00580          RET
00590 ;
00600 ;  ROUTINE TO SET DECEL FACTOR AT THE END OF A PIECE
00610 ;
00620 RBRAKE   LD      HL,AUTOFL+2       ;OVER RUN FLAG SET ?
00630          BIT     3,(HL)
00640          JR      Z,RBRAK3          ;NO
00650          RES     3,(HL)            ;YES, RESET FLAG
00660          LD      A,(BRAKE+1)       ;ADD # OF OVER RUN
00670          LD      B,A               ;   STITCHES TO PRESENT
00680          LD      A,(DECEL)         ;   DECEL FACTOR AND
00690          ADD     A,B               ;   STORE IN OVERRN
00700          INC     A
00710          CP      0FEH              ;LIMIT TO -2(LOWER LIMIT)
00720          JP      P,RBRAK1          ;ALREADY > -2
00730          LD      A,29              ;ERROR
00740          LD      (ERRCD),A
```

TABLE 7 cont'd.

```
00750            CALL    RERDIS          ;DISPLAY ERROR CODE
00760            LD      A,0FEH
00770 RBRAK1:    LD      (OVERRN),A
00780            LD      A,(DECEL)       ;ADD BRAKE + 1 TO DECEL
00790            ADD     A,B
00800            LD      C,0
00810            CP      0FDH            ;LIMIT DECEL TO > -3
00820            JP      P,RBRAK4
00830            LD      A,0FDH
00840 RBRAK4:    LD      (DECEL),A
00850            LD      HL,0            ;ZERO BRAKE
00860            LD      (BRAKE),HL
00870 RBRAK2:    LD      A,(OVERRN)      ;IS OVERRN > DECEL
00880            LD      B,A
00890            LD      A,(DECEL)
00900            CP      B
00910            JP      M,RBRAK5        ;YES, NO LIMIT
00920            LD      A,1             ;WERE THERE 2 OR MORE
00930            CP      C               ;  SLOW STITCHES ?
00940            JR      C,RBRAK7        ;YES
00950 RBRAK6:    LD      A,(DECEL)
00960            DEC     A
00970            CP      0FDH            ;HAS TO BE > -3
00980            JP      M,RBRAK5
00990            LD      (DECEL),A
01000            JR      RBRAK2
01010 RBRAK3:    LD      A,(BRAKE)       ;HAS BRAKE CHANGED
01020            OR      A
01030            RET     Z               ;NO, BRAKE = 0
01040            LD      B,A             ;YES, ADD TO DECEL
01050            LD      C,A
01060            LD      A,(DECEL)
01070            LD      D,A
01080            ADD     A,B
01090            JR      RBRAK4
01100 RBRAK7     LD      C,0
01110            INC     D
01120            LD      A,(OVERRN)
01130            CP      D
01140            JR      NZ,RBRAK6
01150            INC     A
01160            CP      6               ;INSURE L T E  5
01170            JP      M,RBRAK8
01180            LD      A,5
01190 RBRAK8     LD      (OVERRN),A
01200            JR      RBRAK2
01210 RBRAK5     LD      HL,(BSPNTR)     ;GET SEGMENT POINTER
01220            LD      A,(DECEL)
01230            AND     0FH             ;SAVE DECEL AND OVERRN IN
01240            LD      (HL),A          ;  PROG  BEGIN SEGMENT
01250            INC     HL
01260            LD      A,(OVERRN)
01270            AND     0FH             ;MASK OFF OVERRN TO ONE
01280            LD      (HL),A          ;  BYTE
01290            CALL    RCKSUM          ;NEW CHECK SUM
01300            INC     HL
01310            INC     HL
01320            LD      (HL),D
01330            RET
```

TABLE 7 cont'd.

```
00890 ;  ROUTINE TO DECODE ANOTHER STITCH CMD IN AUTO MODE
00900 ;
00910 RGETST:: LD      HL,AUTOFL+2      ;CNTR INHIBIT FLG SET?
00920          BIT     1,(HL)
00930          JP      NZ,RGET19        ;YES - GO CHECK FAB SNSR
00940          LD      HL,(SMSTCT)      ;NO, INC. SEAM STITCH CNT
00950          INC     HL
00960          LD      (SMSTCT),HL
00970          LD      HL,(SEGCNT)      ;DECR. SEGMENT CNT
00980          LD      DE,1
00990          OR      A
01000          SBC     HL,DE
01010          JR      Z,RGET03         ;SEG. CNT = 0
01020          JP      M,RGET34         ;SEG. CNT = -1, ERROR
01030          LD      (SEGCNT),HL      ;SEG. CNT G.T.E. 1
01040          LD      A,(STCHCT)       ;GET CNT OF STCHS DECODED
01050          DEC     A
01060          LD      (STCHCT),A
01070          CP      0                ;OUT OF DECODED STCHS ?
01080          JP      NZ,RGET19        ;NO
01090          JR      RGET04           ;YES
01100 RGET03:  LD      (SEGCNT),HL
01110          RET
01120 RGET04:  LD      HL,(NXTCMD)      ;DECODE NEXT CMD
01130          LD      A,(HL)
01140          INC     HL
01150          LD      (NXTCMD),HL
01160          LD      D,A              ;SAVE CMD
01170          AND     0E0H             ;GET CMD CODE
01180          CP      60H
01190          JR      NZ,RGET06
01200          LD      A,1              ;SINGLE STITCH
01210 RGET05:  LD      (STCHCT),A
01220          LD      (LSSTCT),A
01230          LD      A,D
01240          AND     1FH
01250          LD      (AUTSPD),A
01260          JP      RGET19
01270 RGET06:  CP      80H
01280          JR      NZ,RGET07
01290          LD      HL,(NXTCMD)      ;MULTIPLE STITCH
01300          LD      A,(HL)
01310          INC     HL
01320          LD      (NXTCMD),HL
01330          AND     1FH
01340          JR      RGET05
01350 RGET07:  CP      0A0H
01360          JR      NZ,RGET18        ;NOT A VALID CMD
01370          LD      A,D              ;MISC. CMDS
01380          AND     0FH              ;GET CODE
01390          CP      0
01400          JR      NZ,RGET09
01410          LD      A,(CMNDS)        ;REVERSE
01420          OR      02H
01430 RGET08:  CALL    ROUTCD
01440          JR      RGET04           ;DECODE ANOTHER CMD
01450 RGET09:  CP      1
01460          JR      NZ,RGET10
01470          LD      A,(CMNDS)        ;FORWARD
```

TABLE 7 cont'd.

```
01480          AND     0FDH
01490          JP      RGET08
01500 RGET10:  CP      5
01510          JR      NZ,RGET11
01520          LD      HL,AUTOFL+1        ;OPERATOR ASSIST
01530          SET     0,(HL)
01540          LD      A,(LIGHTS)         ;TURN ON OP. ASST. LT.
01550          OR      08H
01560          CALL    ROUTLT
01570          JR      RGET04             ;DECODE ANOTHER CMD
01580 RGET11:  CP      7
01590          JR      NZ,RGET12
01600          LD      HL,FCTS            ;EXT. FCT. 4 ON
01610          SET     3,(HL)
01620          JR      RGET17
01630 RGET12:  CP      8
01640          JR      NZ,RGET13
01650          LD      HL,FCTS            ;EXT. FCT. 4 OFF
01660          RES     3,(HL)
01670          JR      RGET17
01680 RGET13:  CP      9
01690          JR      NZ,RGET14
01700          LD      HL,FCTS            ;EXT. FCT. 5 ON
01710          SET     4,(HL)
01720          JR      RGET17
01730 RGET14:  CP      0AH
01740          JR      NZ,RGET15
01750          LD      HL,FCTS            ;EXT. FCT. 5 OFF
01760          RES     4,(HL)
01770          JR      RGET17
01780 RGET15:  CP      0BH
01790          JR      NZ,RGET16
01800          LD      HL,FCTS            ;EXT. FCT. 6 ON
01810          SET     5,(HL)
01820          JR      RGET17
01830 RGET16:  CP      0CH
01840          JR      NZ,RGET18          ;NOT A VALID CMD
01850          LD      HL,FCTS            ;EXT. FCT. 6 OFF
01860          RES     5,(HL)
01870 RGET17:  LD      A,(CMNDS)
01880          JR      RGET08
01890 RGET18:  LD      A,16               ;ERROR - INVALID CMD
01900          JP      RGET35             ;GO TO ERROR STATES
01910 RGET19:  LD      HL,AUTOFL          ;FAB SNSR ENABLE FL SET?
01920          BIT     6,(HL)
01930          JR      NZ,RGET21          ;YES
01940 RGET20:  LD      HL,(SEGCNT)        ;NO - CONTINUE SEWING
01950          RET
01960 ;
01970 RGET21:  CALL    RSENRD             ;READ SENSORS
01980          LD      HL,FBSNCD          ;COMPARE TO OLD VALUE
01990          CP      (HL)
02000          JR      NZ,RGET28          ;NOT THE SAME
02010          LD      HL,CTLFL+1         ;SAME, CHECK TOGGLE BITS
02020          BIT     0,(HL)             ;SENSOR 1 TOGGLE BIT SET?
02030          JR      Z,RGET22           ;NO - CHECK SENSOR 2
02040          SET     2,(HL)             ;YES, SET SEN 1 WRITE BIT
02050          RES     0,(HL)             ;RESET SEN 1 TOGGLE BIT
```

TABLE 7 cont'd.

```
02060 RGET22: BIT   1,(HL)          ;SENSOR 2 TOGGLE SET ?
02070         JR    Z,RGET23        ;NO
02080         SET   3,(HL)          ;SET SEN 2 WRITE BIT
02090         RES   1,(HL)          ;RESET SEN 2 TOGGLE BIT
02100 RGET23: LD    HL,CTLFL+1
02110         BIT   2,(HL)          ;SENSOR 1 WRITE BIT SET?
02120         JR    Z,RGET26        ;NO
02130         RES   0,(HL)          ;YES - RESET FLAGS
02140         RES   2,(HL)
02150 RGET24: LD    A,(TOGGLE)      ;DEC # OF TOGGLES
02160         DEC   A
02170         LD    (TOGGLE),A
02180         CP    0
02190         JR    NZ,RGET25       ;NOT TO FINAL COND  YET
02200         LD    HL,AUTOFL       ;RES SENSOR ENABLE
02210         RES   6,(HL)
02220         JP    RFSINI
02230 RGET25: LD    HL,CTLFL+1
02240         BIT   2,(HL)          ;SENSOR 1 WRITE BIT SET
02250         JR    Z,RGET26        ;NO
02260         RES   0,(HL)          ;YES, DEC TOGGLE
02270         RES   2,(HL)          ;RESET WRITE & TOGGLE BIT
02280         JR    RGET24
02290 RGET26  BIT   3,(HL)          ;SENSOR 2 WRITE BIT SET
02300         JR    Z,RGET33        ;NO
02310         RES   1,(HL)          ;YES, DEC TOGGLE
02320         RES   3,(HL)          ;RESET WRITE & TOGGLE BIT
02330         JR    RGET24
02340 RGET28: LD    B,A
02350         XOR   (HL)            ;SEE IF SENSOR 1 CHANGED
02360         AND   01H             ;MASK OFF SENSOR 2
02370         LD    HL,CTLFL+1
02380         JR    Z,RGET29        ;NO
02390         BIT   0,(HL)          ;YES, SEN. 1 TOG. BIT SET
02400         RES   0,(HL)
02410         JR    NZ,RGET30       ;YES, BIT IS RESET NOW
02420         SET   0,(HL)          ;NO, SET SEN 1 TOG. BIT
02430         JR    RGET30
02440 RGET29: BIT   0,(HL)          ;SEN. 1 TOGGLE BIT SET?
02450         JR    Z,RGET30        ;NO, CHECK SENSOR 2
02460         SET   2,(HL)          ;YES, SET SEN 1 WRITE BIT
02470 RGET30: LD    HL,FBSNCD
02480         LD    A,B
02490         XOR   (HL)            ;SENSOR 2 CHANGED ?
02500         AND   02H             ;MASK OFF SENSOR 1
02510         LD    HL,CTLFL+1
02520         JR    Z,RGET31        ;NO
02530         BIT   1,(HL)          ;SENSOR 2 TOGGLE BIT SET?
02540         RES   1,(HL)
02550         JR    NZ,RGET32       ;YES, BIT IS RESET NOW
02560         SET   1,(HL)          ;NO, SET SEN 2 TOGGLE BIT
02570         JR    RGET32
02580 RGET31: BIT   1,(HL)          ;SENSOR 2 TOGGLE BIT SET?
02590         JR    Z,RGET32        ;NO
02600         SET   3,(HL)          ;YES, SET SEN 2 WRITE BIT
02610 RGET32: LD    HL,FBSNCD       ;SAVE SENSOR CONDITION
02620         LD    A,B
02630         LD    (HL),A
```

TABLE 7 cont'd.

```
02640          JR      RGET25          ;CHECK WRITE BITS
02650 RGET33:  LD      A,(STATE)       ;CALLED FROM STATE 37 ?
02660          CP      37
02670          RET     Z               ;YES
02680          LD      HL,(SMSTCT)     ;SNSR CONDITION OVERDUE?
02690          LD      DE,(FBSNCT)
02700          OR      A
02710          SBC     HL,DE
02720          JP      NZ,RGET20       ;NO - CONTINUE
02730          LD      HL,AUTOFL+2     ;YES-SET CNTR INH. FLG
02740          SET     1,(HL)
02750          LD      HL,AUTOFL       ;IS OP. STOP FLG SET ?
02760          BIT     5,(HL)
02770          JP      NZ,RGET20       ;YES
02780          POP     HL              ;NO - DUMMY RETURN
02790          LD      C,37            ;GO WAIT FOR SENSORS
02800          JP      RSTCHG
02810 RGET34   LD      (SEGCNT),HL     ;SAVE OVER RUN STITCHES
02820          CALL    RBRAKO          ;CHECK DECEL FACTOR
02830          LD      HL,0
02840          RET
02850 RGET35:  LD      (ERRCD),A
02860          LD      C,50
02870          JP      RSTCHG
02880          PAGE
02900 ;   ROUTINE TO DYNAMIC BRAKE IF RUNNING TOO FAST WHEN
02910 ;      CLOSE TO END OF SEGMENT
02920 ;
02930 RWHOA:   LD      A,(AUTOFL)      ;FAB. SNSR WNDW ENABLED?
02940          BIT     6,A
02950          RET     NZ              ;YES - NO ACTION
02960          LD      A,(K)           ;NO, IS SEGCNT G.T. K ?
02970          LD      E,A
02980          LD      D,0
02990          SCF
03000          SBC     HL,DE
03010          JR      C,RWHOA1        ;NO - NO ACTION
03020          LD      DE,12           ;YES, SEGCNT L.T.E. K+12?
03030          OR      A
03040          SBC     HL,DE
03050          JR      NC,RWHOA1       ;NO, THEN NO ACTION
03060          ADD     HL,DE           ;SEGCNT = STITCH # - 2
03070          INC     HL
03080          LD      A,L
03090          LD      HL,FLPTBN       ;PLACE STITCH COUNT IN
03100          LD      (HL),A          ;   TEMPORARY LOCATION
03110          INC     HL
03120          LD      (HL),0          ;ZERO REST OF BUFFER
03130          INC     HL
03140          LD      (HL),0
03150          LD      A,(DECEL)       ;GET DECEL FACTOR
03160          LD      B,A             ;MULTIPLY DECEL X 3
03170          SLA     A
03180          ADD     A,B
03190          JP      P,RWHOA2        ;DECEL POS THEN JR AROUND
03200          LD      D,0FFH          ;FILL IN NEG. SIGN
03210 RWHOA2:  LD      E,A
03220          LD      HL,SPDTBL       ;GET SLOPE FACTOR FROM
```

TABLE 7 cont'd.

```
03230          ADD     HL,DE            ;   TABLE
03240          LD      DE,FLPTBN
03250          EX      DE,HL
03260          CALL    RINTDV           ;DIVIDE DE/HL
03270          INC     HL
03280          INC     HL
03290          INC     HL
03300          LD      A,(HL)           ;PLACE SPEED LIMIT IN DE
03310          LD      E,A
03320          INC     HL
03330          LD      A,(HL)
03340          LD      D,A
03350          LD      HL,(TMREV)       ;IS SPD G.T. LIMIT ?
03360          OR      A
03370          SBC     HL,DE
03380          JR      NC,RWHOA1        ;NO - CONTINUE
03390          LD      A,0              ;YES - BRAKE AND RUN PLATEAU
03400          LD      (SD),A
03410          LD      HL,CTLFL
03420          SET     1,(HL)
03430          POP     HL               ;DUMMY RETURN
03440          LD      C,31
03450          JP      RSTCHG
03460 RWHOA1:  LD      HL,(SEGCNT)
03470          RET
03480          PAGE
03490          IF      EPROM
03500 ;
03510          DW      1563             ;SPD SLOPE AT -3 (OVERUN)
03520          DB      0
03530          DW      1379             ;SPD SLOPE AT -2 (OVERUN)
03540          DB      0
03550          DW      1172             ;SPD SLOPE AT -1 (OVERUN)
03560          DB      0
03570 SPDTBL:  DW      977              ;SPD SLOPE  STANDARD
03580          DB      0
03590          DW      781              ;SPD SLOPE AT +1 S.S.
03600          DB      0
03610          DW      586              ;SPD SLOPE AT +2 S.S.
03620          DB      0
03630          DW      391              ;SPD SLOPE AT +3 S.S
03640          DB      0
03650          DW      195              ;SPD SLOPE AT +4 S.S
03660          DB      0
03670 ;
03680          ELSE
03690 ;
03700          DW      1109             ;SPD SLOPE FOR -3
03710          DB      0
03720          DW      978              ;SPD SLOPE FOR -2
03730          DB      0
03740          DW      832              ;SPD SLOPE FOR -1
03750          DB      0
03760 SPDTBL:  DW      693              ;SPD SLOPE FOR STANDARD
03770          DB      0
03780          DW      554              ;SPD SLOPE FOR +1 S.S
03790          DB      0
03800          DW      416              ;SPD SLOPE FOR +2 S.S.
```

TABLE 7 cont'd.

```
03810          DB      0
03820          DW      277              ;SPD SLOPE FOR +3 S.S.
03830          DB      0
03840          DW      139              ;SPD SLOPE FOR +4 S.S.
03850          DB      0
03860 ;
03870          ENDIF
03880          PAGE
03900 ;  ROUTINE TO RESET STITCH COUNTERS AND TAUGHT COMMAND
03910 ;     POINTER TO STITCH AT WHICH FABRIC SENSOR CHANGE WAS
03920 ;     DETECTED DURING TEACH MODE
03930 ;
03940 RFSINI::LD       HL,AUTOFL+2      ;RST CNTR INHIBIT
03950          RES     1,(HL)
03960          CALL    RDECNC           ;DECR. PNTR TO PRESENT CM
03970 RFS1:    LD      HL,(FBSNCT)      ;PNTRS SET TO RIGHT STCH?
03980          LD      DE,(SMSTCT)
03990          OR      A
04000          SBC     HL,DE
04010          JR      Z,RFS2           ;YES - NO ADJ. NEEDED
04020          JP      NC,RFS3          ;NEED TO SKIP SOME STCHS
04030          JP      RFS4             ;NEED TO REPEAT SOME STS
04040 RFS2:    CALL    RINCNC           ;INCR. PNTR TO NEXT CMD
04050          LD      HL,(SEGCNT)      ;IS SEG. CNT G.T. K ?
04060          LD      D,0
04070          LD      A,(K)
04080          LD      E,A
04090          SCF
04100          SBC     HL,DE
04110          JR      NC,RFS5          ;YES
04120 RFS17:   LD      A,0              ;NO - SET PLAT. SPD
04130          LD      (SD),A
04140          LD      HL,CTLFL         ;SET STOP OVERRIDE BIT
04150          SET     1,(HL)
04160          POP     HL               ;DUMMY RETURN
04170          LD      C,31             ;GO SEW PLATEAU SPD
04180          JP      RSTCHG
04190 RFS5:    LD      A,(SPSTA)        ;ALREADY IN DYN. BRAKE ?
04200          CP      2
04210          JR      Z,RFS17          ;YES
04220          CP      5
04230          RET     Z                ;STOPPED - DON'T RESTART
04240          LD      A,(CMNDS)        ;INSURE NOT IN PLAT. MD
04250          AND     07H
04260          CALL    ROUTCD
04270          LD      A,1
04280          LD      (SPSTA),A
04290          LD      A,(AUTSPD)       ;SET SPD = TAUGHT SPD
04300          LD      (SD),A
04310          CALL    RLSPIN           ;APPLY LRN SPD INCREASE
04320          POP     HL               ;DUMMY RETURN
04330          LD      C,28             ;SEW TAUGHT PROFILE
04340          JP      RSTCHG
04350 RFS3:    LD      HL,(SEGCNT)      ;SKIP A STITCH
04360          DEC     HL
04370          LD      (SEGCNT),HL
04380          LD      HL,(SMSTCT)
04390          INC     HL
```

TABLE 7 cont'd.

```
04400          LD      (SMSTCT),HL
04410          LD      A,(STCHCT)
04420          DEC     A
04430          LD      (STCHCT),A
04440          JR      NZ,RFS1          ;CHECK IF ENOUGH SKIPPED
04450 RFS9:    CALL    RINCNC           ;GET NEXT TAUGHT CMD
04460          LD      A,(HL)
04470          LD      D,A              ;SAVE IT
04480          AND     0E0H
04490          CP      60H
04500          JR      Z,RFS6           ;SINGLE STITCH
04510          CP      80H
04520          JR      Z,RFS7           ;MULTIPLE STITCH
04530          CP      20H
04540          JR      Z,RFS8           ;BEGIN SEGMENT
04550          CP      40H
04560          JR      Z,RFS9           ;PAUSE - GET ANOTHER CMD
04570          CP      0A0H
04580          JR      Z,RFS9           ;MISC. CMD - GET ANOTHER
04590          LD      A,20             ;INVALID - SET ERR. CODE
04600          LD      (ERRCD),A
04610          LD      C,50             ;GO TO ERROR STATE
04620          JP      RSTCHG
04630 RFS6:    LD      A,D              ;GET TAUGHT SPD
04640          AND     1FH
04650          LD      (AUTSPD),A
04660          LD      A,1              ;CNT OF STCHS DECODED=1
04670          LD      (STCHCT),A
04680          JP      RFS1
04690 RFS7:    LD      A,D              ;GET TAUGHT SPD
04700          AND     1FH
04710          LD      (AUTSPD),A
04720          INC     HL               ;GET SECOND BYTE
04730          LD      A,(HL)
04740          LD      (STCHCT),A       ;CNT OF STCHS DECODED
04750          JP      RFS1
04760 RFS8:    LD      A,D              ;GET SEGMENT CNT
04770          AND     1FH
04780          LD      D,A
04790          LD      E,0
04800          LD      B,3
04810 RFS10:   SRL     D
04820          RR      E
04830          DJNZ    RFS10
04840          INC     HL               ;SECOND BYTE
04850          LD      A,(HL)
04860          OR      E
04870          LD      E,A
04880          LD      (SEGCNT),DE      ;SAVE SEG. CNT
04890          JP      RFS9             ;GET ANOTHER CMD
04900 RFS4:    LD      A,(LSSTCT)       ;ST. CNT = ORIGINAL CNT?
04910          LD      B,A
04920          LD      A,(STCHCT)
04930          CP      B
04940          JR      NC,RFS11         ;YES
04950 RFS12:   LD      HL,(SEGCNT)      ;NO - BACK UP A STITCH
04960          INC     HL
04970          LD      (SEGCNT),HL
```

TABLE 7 cont'd.

```
04980          LD      HL,(SMSTCT)
04990          DEC     HL
05000          LD      (SMSTCT),HL
05010          INC     A
05020          LD      (STCHCT),A
05030          JP      RFS1            ;CHCK IF BACKED UP ENOUGH
05040 RFS11:   CALL    RDECNC          ;GET PREVIOUS TAUGHT CMD
05050          LD      A,(HL)
05060          LD      D,A             ;SAVE IT
05070          AND     0E0H
05080          CP      60H
05090          JR      Z,RFS13         ;SINGLE STITCH
05100          CP      80H
05110          JR      Z,RFS14         ;MULTIPLE STITCH
05120          CP      20H
05130          JR      Z,RFS15         ;BEGIN SEGMENT
05140          CP      40H
05150          JR      Z,RFS11         ;PAUSE - GET ANOTHER CMD
05160          CP      0A0H
05170          JR      Z,RFS11         ;MISC. CMD - GET ANOTHER
05180          LD      A,21            ;INVALID - SET ERR  CODE
05190          LD      (ERRCD),A
05200          LD      C,50            ;GO TO ERROR STATE
05210          JP      RSTCHG
05220 RFS13:   LD      A,D             ;GET TAUGHT SPD
05230          AND     1FH
05240          LD      (AUTSPD),A
05250          LD      A,1             ;SET ORG. ST. CNT = 1
05260 RFS16:   LD      (LSSTCT),A
05270          LD      A,0             ;SET CNT DECODED = 0
05280          JP      RFS12           ;BACK UP A STITCH
05290 RFS14    LD      A,D             ;GET TAUGHT SPD
05300          AND     1FH
05310          LD      (AUTSPD),A
05320          INC     HL
05330          LD      A,(HL)
05340          JR      RFS16
05350 RFS15    LD      HL,0            ;CLEAR SEG  CNT
05360          LD      (SEGCNT),HL
05370          JR      RFS11
05380          PAGE
01830 ;  ROUTINE TO COMPARE SENSORS TO PREVIOUS VALUE AND SET
01840 ;    TOGGLE FLAG IF DIFFERENT, SAVE IN BEGIN SEAM COMMAND
01850 ;    IF THE TOGGLE FLAG IS ALREADY SET   IGNORE ONE STITCH
01860 ;    TOGGLES.
01870 ;
01880 RRFS::   CALL    RSENRD          ;READ SENSORS
01890          LD      HL,TCHFL
01900          BIT     1,(HL)          ;START SEAM SET ?
01910          JR      Z,RRFS4         ;NO
01920          RES     1,(HL)          ;YES, RESET START SEAM
01930          RES     0,(HL)          ;RESET START PIECE FLG
01940          LD      HL,FBSNCD       ;SAVE INITIAL CONDITION
01950          LD      (HL),A
01960          JP      RSENFL          ;WRITE INITIAL SENSOR CD.
01970 RRFS4:   LD      HL,FBSNCD       ;COMPARE TO OLD VALUE
01980          CP      (HL)
```

TABLE 7 cont'd.

```
01990          JR      NZ,RRFS8          ;NOT THE SAME
02000          LD      HL,CTLFL+1        ;SAME, CHECK TOGGLE BITS
02010          BIT     0,(HL)            ;SENSOR 1 TOGGLE BIT SET?
02020          JR      Z,RRFS13          ;NO - CHECK SENSOR 2
02030          SET     2,(HL)            ;YES, SET SEN 1 WRITE BIT
02040          RES     0,(HL)            ;RESET SEN 1 TOGGLE BIT
02050 RRFS13:  BIT     1,(HL)            ;SENSOR 2 TOGGLE SET ?
02060          JR      Z,RRFS5           ;NO
02070          SET     3,(HL)            ;SET SEN 2 WRITE BIT
02080          RES     1,(HL)            ;RESET SEN 2 TOGGLE BIT
02090 RRFS5:   LD      HL,CTLFL+1
02100          BIT     2,(HL)            ;SENSOR 1 WRITE BIT SET?
02110          JR      Z,RRFS7           ;NO
02120          RES     0,(HL)            ;YES - RESET FLAGS
02130          RES     2,(HL)
02140 RRFS6:   LD      HL,TCHFL
02150          BIT     6,(HL)            ;IN OP. ASSIST ?
02160          RET     NZ                ;YES - NO ACTION
02170          JP      RBSMFL            ;FILL IN BEGIN SEAM
02180 RRFS7:   BIT     3,(HL)            ;SENSOR 2 WRITE BIT SET?
02190          RET     Z                 ;NO
02200          RES     1,(HL)            ;YES - RESET FLAGS
02210          RES     3,(HL)
02220          JR      RRFS6
02230 RRFS8:   LD      B,A
02240          XOR     (HL)              ;SEE IF SENSOR 1 CHANGED
02250          AND     01H               ;MASK OFF SENSOR 2
02260          LD      HL,CTLFL+1
02270          JR      Z,RRFS9           ;NO
02280          BIT     0,(HL)            ;YES, SEN. 1 TOG. BIT SET
02290          RES     0,(HL)
02300          JR      NZ,RRFS10         ;YES, BIT IS RESET NOW
02310          SET     0,(HL)            ;NO, SET SEN. 1 TOG. BIT
02320          JR      RRFS10
02330 RRFS9:   BIT     0,(HL)            ;SEN. 1 TOGGLE BIT SET?
02340          JR      Z,RRFS10          ;NO, CHECK SENSOR 2
02350          SET     2,(HL)            ;YES, SET SEN 1 WRITE BIT
02360 RRFS10:  LD      HL,FBSNCD
02370          LD      A,B
02380          XOR     (HL)              ;SENSOR 2 CHANGED ?
02390          AND     02H               ;MASK OFF SENSOR 1
02400          LD      HL,CTLFL+1
02410          JR      Z,RRFS11          ;NO
02420          BIT     1,(HL)            ;SENSOR 2 TOGGLE BIT SET?
02430          RES     1,(HL)
02440          JR      NZ,RRFS12         ;YES, BIT IS RESET NOW
02450          SET     1,(HL)            ;NO, SET SEN 2 TOGGLE BIT
02460          JR      RRFS12
02470 RRFS11:  BIT     1,(HL)            ;SENSOR 2 TOGGLE BIT SET?
02480          JR      Z,RRFS12          ;NO
02490          SET     3,(HL)            ;YES, SET SEN 2 WRITE BIT
02500 RRFS12:  LD      HL,FBSNCD         ;SAVE SENSOR CONDITION
02510          LD      A,B
02520          LD      (HL),A
02530          JR      RRFS5             ;CHECK WRITE BITS
02540          PAGE
02550 ;
```

TABLE 7 cont'd.

```
02560 ;   ROUTINTE TO READ THE SENSORS IN AUTO MODE IF THE FIRST
02570 ;     STITCH OF THE SEAM HAS BEEN COMPLETED   RESETS
02580 ;     SENSOR WINDOW ENABLE FLAG IF SENSORS ARE NOT THE
02590 ;     SAME AS THE FIRST STITCH IN TEACH MODE
02600 ;
02610 RASNRD  LD      HL,AUTOFL+2      ;READ SENSOR ENABLED ?
02620         BIT     2,(HL)
02630         RET     Z                ;NO
02640         RES     2,(HL)           ;YES, RESET FLAG AND
02650         CALL    RSENRD           ;READ SENSORS
02660         LD      HL,FBSNCD        ;COMPARE TO TEACH MODE
02670         CP      (HL)             ;  SENSOR READING
02680         RET     Z                ;SAME
02690         LD      HL,AUTOFL        ;NOT = , STITCH COUNT SM
02700         RES     6,(HL)           ;RES WINDOW ENABLE FLAG
02710         RET
02720         PAGE
```

We claim:

1. In a semi-automatic sewing system including a sewing machine with a reciprocal needle for stitching material advanced in a feed direction and controls for operating said sewing machine, with means for counting stitches being sewn and with sensors for detecting manipulation of the sewing machine controls, the improvement which comprises:

means mounted in spaced relationship with said needle for sensing the material periphery following a seam; and a microprocessor controller with plural operational modes coupled to said sewing machine controls and responsive to said stitch counting means and said material sensing means;

said microprocessor controller in one mode being operable to record for each seam the operational input sequence of said sewing machine controls as a function of stitch count, the sewing speed for each stitch sewn, the toggle history of said material sensing means, and a variable number of terminal stitches between detection of the material periphery by said material sensing means and the endpoint of said seam;

said microprocessor controller in another mode being operable to generate output control signals for said sewing machine to initiate countdown of said variable number of terminal stitches upon detection of the material periphery by said material detection means and upon correspondence of the sensed and stored sensor toggle histories for each seam, wherein said microprocessor controller in said another mode is responsive to said material detection means only for sensor toggles which last more than a preprogrammed few number of stitch counts to avoid spurious signals.

2. The semi-automatic sewing system of claim 1, wherein said material sensing means comprises at least one on/off sensor located ahead of said needle in a direction opposite the material feed direction.

3. The semi-automatic sewing system of claim 1, wherein said material sensing means comprises an infrared emitter of variable output and an associated sensor located ahead of said needle in a direction opposite the material feed direction.

4. The semi-automatic sewing system of claim 1, wherein said microprocessor controller in said one mode stores the total number of stitches required for each seam, and wherein said microprocessor controller in said other mode reverts to said total stitch count for determining seam length absent detection of the material periphery and correspondence of the sensed and stored toggle histories of said material sensing means.

5. In a semi-automatic sewing system including a sewing machine with a reciprocal needle for stitching material advanced in a feed direction and controls for operating said sewing machine, with means for counting stitches being sewn and with sensors for detecting manipulation of the sewing machine controls, the improvement which comprises:

means mounted in spaced relationship with said needle for sensing the material periphery following a seam; and a microprocessor controller with plural operational modes coupled to said sewing machine controls and responsive to said stitch counting means and said material sensing means;

said microprocessor controller in one mode being operable to record for each seam the operational input sequence of said sewing machine controls as a function of stitch count, the sewing speed for each stitch sewn, and a variable number of terminal stitches between detection of the material periphery by said material sensing means and the endpoint of said seam;

said microprocessor controller in another mode being operable to generate output control signals for said sewing machine to initiate countdown of said variable number of terminal stitches upon detection of the material periphery by said material detection means, wherein said microprocessor controller in said another mode monitors the stitches sewn during deceleration of the sewing machine to a seam endpoint and adaptively adjusts the point at which deceleration is initiated in order to minimize the number of slow stitches at the end of each seam.

6. The semi-automatic sewing system according to claim 5, wherein said microprocessor controller in said other mode further compares the adaptive number of stitches required to decelerate said sewing machine to a precise stop with the number of stitches remaining to be sewn in the seam and utilizes, as a basis for terminating the seam, the last toggle point of said material sensing means which provides a sufficient number of stitches to decelerate and halt said sewing machine.

7. In a semi-automatic sewing system including a sewing machine with a reciprocal needle for stitching material advanced in a feed direction and controls for operating said sewing machine, with means for counting stitches being sewn and with sensors for detecting manipulation of the sewing machine controls, the improvement which comprises:

means mounted in spaced relationship with said needle for sensing the material periphery following a seam;

a microprocessor controller with plural operational modes coupled to said sewing machine controls and responsive to said stitch counting means and said material sensing means;

said microprocessor controller in one mode being operable to record for each seam the operational input sequence of said sewing machine controls as a function of stitch count, the sewing speed for each stitch sewn, the toggle history of said material sensing means, and a variable number of terminal stitches between detection of the material periphery by said material sensing means and the endpoint of said seam;

said microprocessor controller in another mode being operable to generate output control signals for said sewing machine to initiate countdown of said variable number of terminal stitches upon detection of the material periphery by said material detection means and upon correspondence of the sensed and stored sensor toggle histories for each seam;

means for substantially continuously sensing the position of the reciprocal needle of said sewing machine;

said microprocessor controller being responsive to said needle position sensing means, and being further operable in said one mode to record the point in the relevant needle reciprocation at which each toggle of said material sensing means occurs; and said microprocessor controller being further operable in said another mode to adaptively adjust said terminal number of stitches for each seam in accordance with the sensed point in the relevant needle reciprocation at which the seam-termination toggle of said material sensing means occurs in order to improve seam length accuracy.

8. The semi-automatic sewing system according to claim 7, wherein said microprocessor controller in said other mode further compensates for the type of material feed characteristics of said sewing machine.

9. A semi-automatic sewing system, comprising:

a sewing machine;

said sewing machine including a reciprocal needle for stitching a seam in material advanced along a feed direction, and controls for operating said sewing machine;

means for driving said sewing machine;

said driving means including a variable speed motor with a shaft, an electromagnetic brake mounted on the motor shaft, and means for sensing rotation and angular displacement of the motor shaft;

means for counting stitches being sewn by said sewing machine;

a sensor mounted in spaced relationship ahead of said sewing machine needle for detecting the material edge following a seam;

a microprocessor controller operatively associated with said stitch counting means, sewing machine drive means, and sewing machine controls;

said microprocessor controller having plural operational modes and being responsive to said material edge sensor and said motor shaft sensing means;

said microprocessor controller being operable in one mode to record for each seam the operational sequence of said sewing machine controls as a function of stitch count, the sewing speed profile, and an adaptive number of terminal stitches between detection of the material edge by said sensor and the seam endpoint; and said microprocessor controller in another mode being operable to generate output signals for said sewing machine controls and the brake of said driving means to initiate countdown of said adaptive number of terminal stitches upon detection of the material edge by said sensor, wherein said microprocessor controller in said another mode monitors the stitches sewn during deceleration of the sewing machine to a seam endpoint and adaptively adjusts the point at which deceleration is initiated in order to minimize the number of slow stitches at the end of each seam.

10. The semi-automatic sewing system of claim 9, further including:

auxiliary means for performing a predetermined function associated with operation of said sewing machine;

said microprocessor controller in said one mode further being operable to record the operational sequence of said auxiliary means as a function of stitch count; and said microprocessor controller in said other mode further being operable to control said auxiliary means.

11. The semi-automatic sewing system of claim 9, wherein said sensor comprises an infrared emitter of variable sensitivity and an associated sensor located in spaced relationship ahead of said sewing machine needle.

12. The semi-automatic sewing system of claim 9, wherein said microprocessor controller in said one mode stores the total number of stitches required for each seam, and wherein said microprocessor controller in said other mode reverts to said total stitch count for determining seam length absent detection of the material edge by said sensor.

13. The semi-automatic sewing system of claim 9, wherein said microprocessor controller in said one mode also stores the toggle history of said sensor for each seam, with countdown of said adaptive terminal number of stitches in said other mode also being predicated upon correspondence of the sensed and stored sensor toggle histories.

14. The semi-automatic sewing system according to claim 9, wherein said microprocessor controller in said other mode further compares the adaptive number of stitches required to decelerate said sewing machine to a precise stop with the number of stitches remaining to be sewn in the seam and utilizes, as a basis for terminating the seam, the last toggle point of said sensor which provides a sufficient number of stitches to decelerate and halt said sewing machine.

15. A semi-automatic sewing system, comprising:

a sewing machine;

said sewing machine including a reciprocal needle for stitching a seam in material advanced along a feed direction, and controls for operating said sewing machine;

means for driving said sewing machine;

said driving means including a variable speed motor with a shaft, an electromagnetic brake mounted on the motor shaft, and means for sensing rotation and angular displacement of the motor shaft;

means for counting stitches being sewn by said sewing machine;

a sensor mounted in spaced relationship ahead of said sewing machine needle for detecting the material edge following a seam;

a microprocessor controller operatively associated with said stitch counting means, sewing machine drive means, and sewing machine controls;

said microprocessor controller having plural operational modes and being responsive to said material edge sensor and said motor shaft sensing means;

said microprocessor controller being operable in one mode to record for each seam the operational sequence of said sewing machine controls as a function of stitch count, the sewing speed profile, and an adaptive number of terminal stitches between detection of the material edge by said sensor and the seam endpoint; and said microprocessor controller in another mode being operable to generate output signals for said sewing machine controls and the brake of said driving means to initiate countdown of said adaptive number of terminal stitches upon detection of the material edge by said sensor;

said microprocessor controller being responsive to said needle position sensing means, and being further operable in said one mode to record the point in the relevant needle reciprocation at which each toggle of said material sensing means occurs; and said microprocessor controller being further operable in said other mode to adaptively adjust said terminal number of stitches for each seam in accordance with the sensed point in the relevant needle reciprocation at which the seam-termination toggle of said material sensing means occurs in order to improve seam length accuracy.

* * * * *